US005602630A

United States Patent [19]

Endo et al.

[11] Patent Number: 5,602,630

[45] Date of Patent: Feb. 11, 1997

[54] DEVELOPING DEVICE

[75] Inventors: Isao Endo; Toru Komatsu; Yotaro Sato; Kunio Shigeta; Hiroyuki Nomori, all of Tokyo, Japan

[73] Assignee: Konica Corporation, Japan

[21] Appl. No.: 529,092

[22] Filed: Sep. 15, 1995

[30] Foreign Application Priority Data

Sep. 22, 1994 [JP] Japan ..... 6-228075
Sep. 28, 1994 [JP] Japan ..... 6-233438

[51] Int. Cl.[6] ..... G03G 15/09

[52] U.S. Cl. ..... 399/271; 430/122

[58] Field of Search ..... 355/261, 251, 355/253, 246, 259, 245; 118/653, 657, 658; 430/122, 31

[56] References Cited

U.S. PATENT DOCUMENTS

| | | | |
|---|---|---|---|
| 4,634,646 | 1/1987 | Sano et al. | 430/31 |
| 4,949,127 | 8/1990 | Matsuda et al. | 355/251 |
| 5,078,085 | 1/1992 | Fuji et al. | 118/657 |
| 5,079,115 | 1/1992 | Takashima et al. | 430/45 |
| 5,206,693 | 4/1993 | Folkins | 355/261 |
| 5,239,342 | 8/1993 | Kubo et al. | 355/245 |
| 5,333,040 | 7/1994 | Imamiya | 355/246 |
| 5,428,428 | 6/1995 | Haneda | 355/246 |

FOREIGN PATENT DOCUMENTS

| | | |
|---|---|---|
| 5-346736A | 12/1993 | Japan . |
| 6-175485A | 12/1994 | Japan . |

*Primary Examiner*—Thu Anh Dang
*Attorney, Agent, or Firm*—Jordan B. Bierman; Bierman and Muserlian

[57] ABSTRACT

A non-contact type of developing device for use in an image forming apparatus having an image forming body, includes a developer conveying body facing the image forming body in which a magnet body having a plurality of magnet poles are attached therein, to convey two-component developer in the form of a developer layer onto a developing area and a control electrode provided at the developing area or upstream of the developing area. The control electrode has an electrically insulating member which is in contact with or close to the developing layer, and an electrode to which a voltage is applicable is attached to the insulating member. The following condition is satisfied:

$$1.5 < D_T = \frac{3\sqrt{3} \cdot D_{WS} \cdot T_C \cdot vs}{10 \cdot \pi \cdot dt \cdot \rho t \cdot vp} < 9$$

where $D_T$ represents a number of toner layers on the assumption that the toner particles passing through the developing area are filled most densely, $D_{WS}$ represents a conveying amount (mg/cm$^2$) of the developer layer at the developing area on the developer conveying body, $T_c$ represents a toner concentration (%) in the developer, dt represents an average sphere equivalent diameter (μm) of toner in the developer, ρt represents a toner density (g/cm$^3$) in the developer, vs represents a circumferential speed (mm/s) of the developer conveying body at the developing area, and vp represents a circumferential speed (mm/s) of the image forming body at the developing area.

7 Claims, 9 Drawing Sheets

DEVELOPING DEVICE

BACKGROUND OF THE INVENTION

The present invention relates to a developing unit for developing an electrostatic latent image using two-component developer in an image forming apparatus such as an electrophotographic copier.

In the conventional electrophotographic copier, a magnetic brush development type developing device is used to which two-component developer is applied. This developing device includes a developing sleeve, which functions as a cylindrical rotary conveyer to convey developer, and a magnetic roller composed of a magnetic body having a plurality of magnetic poles is provided inside the developing sleeve. Magnetic carrier particles on which toner particles are deposited are held on a surface of the developing sleeve, so that the carrier particles are conveyed to the development region by the developing sleeve.

In general, two-component developer is composed of magnetic carrier particles, the average particle size of which is several tens μm to several hundreds μm, and non-magnetic toner particles, the average particle size of which is approximately 10 μm. When the two-component developer is used for development, the following problems may be encountered. Toner and carrier particles are rough. Therefore, it is difficult to provide an image of high quality on which fine lines and points are reproduced with high fidelity, and further a difference in image density can not be reproduced accurately. Conventionally, they made every effort to obtain images of high quality by this developing method, for example, carrier particles are coated with resin, and the magnetic body assembled into the developer conveyer is improved. In spite of the effort they made, images of sufficiently high quality can not be provided yet. As a result, it is necessary to reduce the sizes of toner and carrier particles so that finer particles can be provided. However, when the average size of toner particles is reduced, specifically, when the average size of toner particles is reduced to not more than 20 μm, particularly when the average size of toner particles is reduced to not more than 10 μm, the following problems may be encountered.

(1) In the process of development, Van der Waals force affects toner particles relatively stronger than Coulomb force. Therefore, toner particles are strongly deposited on the image forming body. Accordingly, toner particles are deposited on the background of an image. As a result, fog is caused. In this case, even if a DC bias voltage is impressed upon the developer conveyer, it is difficult to prevent the occurrence of fog.

(2) Carrier particles are covered by toner particles more thickly. Therefore, it becomes difficult to conduct triboelectric charging control.

(3) When carrier particles are covered by toner particles more thickly, coagulation of toner tends to occur.

(4) When the size of carrier particles is reduced to be fine, carrier particles are also deposited on the electrostatic latent image portion on the image forming body. The reason is that the force generated by the action of the magnetic bias is lowered, so that the carrier particles are deposited on the image forming body together with the toner particles. Further, when the bias voltage is increased, carrier particles are deposited on the background on the image.

Reduction of the sizes of toner and carrier particles is disadvantageous as described above, and it is impossible to provide clear images. Accordingly, it is actually difficult to reduce the sizes of toner and carrier particles from the viewpoint of practical use.

In order to solve the above problems, Japanese Patent Publication Open to Public Inspection Nos. 346736/1993 and 175485/1994 disclose a developing method which will be described below. In the upstream of the developing region, a plate member having an electrode is provided. The plate member comes into contact with the developer conveyer. An oscillating electric field is formed between the electrode and the developer conveyer, and an oscillating electric field is also formed between the developer conveyer and the image forming body. In this case, the intensity of the former electric field is higher than that of the latter electric field. In this way, toner particles in the developer are formed into clouds.

However, the above control electrode method is disadvantageous as follows. In the case of development conducted between magnetic poles in which a magnetic pole is interposed between the image forming body and the developer conveyer at a position where the image forming body is located closest to the developer conveyer, bristles of developer in the development region are made to lay down. In addition to that, the bristles are further suppressed by the plate-shaped electrode provided on the upstream side, so that the bristles of developer become too dense. As a result, toner on the lower layer is difficult to be used for development, and it is necessary to impress a high development bias voltage in which DC and AC components are superimposed. As a result, blur of an image tends to occur due to the electric discharge conducted on the photoreceptor and electrode. In the prior art described above, a technique is disclosed, in which the inner magnet is rotated simultaneously when the developer conveyer is rotated. According to the above technique, the development property fluctuates. Specifically, the development property in the case where the developing region is interposed between the magnetic poles is different from the development property in the case where the development region is located on the magnetic pole. Accordingly, it is impossible to stably provide images of uniform density.

SUMMARY OF THE INVENTION

The present invention has been accomplished to solve the above problems. It is an object of the present invention to provide a two-component non-contact type developing device capable of stably forming images of high quality, that is, images of high resolution and development property, by a lower development bias voltage.

It is possible to accomplish the above object by the following non-contact type developing device. In the developing device, there is provided a developer conveyer opposed to the image forming body, and a magnetic body having a plurality of magnetic poles is fixed inside the developer conveyer. Two-component developer is conveyed to the development region by the developer conveyer. In the developing device, there is provided a control electrode capable of impressing a voltage upon the developer conveyer, wherein the control electrode is arranged in the development region or in the upstream of the development region of the developer conveyer. The control electrode comes into contact with the developer layer, or alternatively the control electrode is located close to the developer layer. The control electrode is fixed by an insulating member. In the aforementioned developing device, the value of $D_T$ expressed by the following expression is in a range from 1.5 to 9.

$$D_T = \frac{3\sqrt{3} \cdot D_{ws} \cdot T_c \cdot vs}{10 \cdot \pi \cdot dt \cdot \rho t \cdot vp}$$

where $D_{ws}$: Amount of conveyed developer (mg/cm$^2$) on the developer conveyer in the developing region Tc: Concentration (%) of toner in developer dt: Average sphere equivalent diameter (μm) of toner in developer ρt: Density of toner (g/cm$^3$) in developer vs: Moving speed (mm/s) of the developer conveyer in the developing region vp: Moving speed (mm/s) of the image forming body in the developing region In the above developing device, it is preferable that a primary magnetic pole is arranged inside of the developing region of the above developer conveyer.

It is possible to accomplish the above object by another embodiment of the non-contact type developing device described as follows. In the developing device, there is provided a developer conveyer opposed to the image forming body, and a magnetic body having a plurality of magnetic poles is fixed inside the developer conveyer. Two-component developer is conveyed to the development region by the developer conveyer. In the developing device, there is provided a control electrode capable of impressing a voltage upon the developer conveyer, wherein the control electrode is arranged in the development region or in the upstream of the development region of the developer conveyer. The control electrode comes into contact with the developer layer, or alternatively the control electrode is located close to the developer layer. The control electrode is fixed by an insulating member. In the aforementioned developing device, the value of $D_{ws}$ is in a range satisfying the following inequality.

$$5 < D_{ws} < 70$$

where $D_{ws}$: Amount of conveyed developer (mg/cm$^2$) on the developer conveyer in the developing region.

Further, the values of $h_1$ and $h_2$ satisfy the following inequality.

$$0.3 < h1/h2 \leq 1$$

where $h_1$: Height of bristles of developer (μm) in the developing region when the control electrode comes into contact with the developer layer or the control electrode is located close to the developer layer $h_2$: Height of bristles of developer (μm) in the developing region when the control electrode does no come into contact with the developer layer or the control electrode is located distant from the developer layer In the above developing device, it is preferable that one of the magnetic poles of the magnetic body of the developer conveyer is arranged at a position opposed to the developing region.

BRIEF DESCRIPTION OF THE DRAWINGS

FIG. 3(*b*) is a sectional view showing an example of the control electrode.

DETAILED DESCRIPTION OF THE PREFERRED EMBODIMENT

Figure 2:
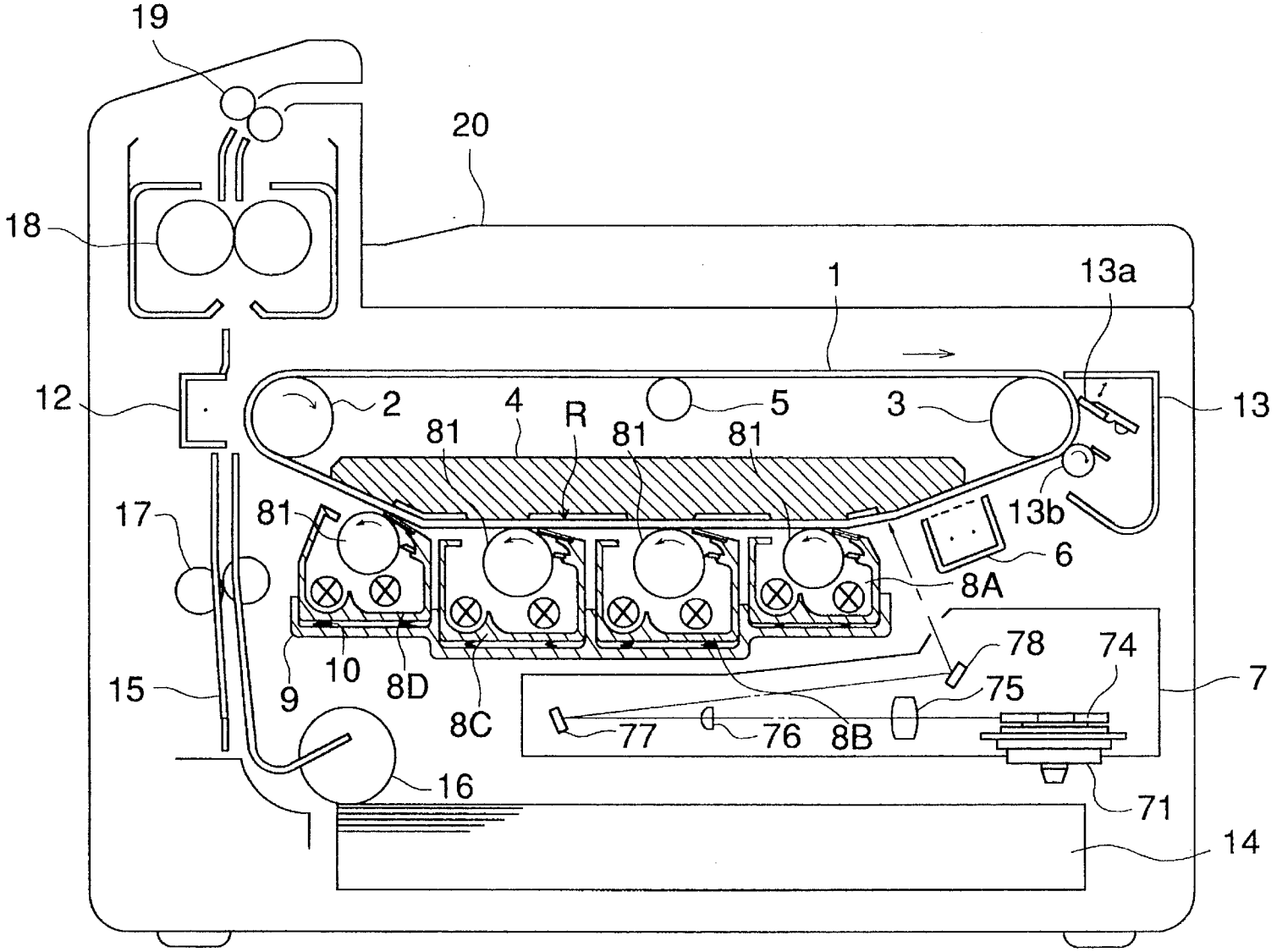
FIG. 2 is an arrangement view showing an outline of the example of the color image forming apparatus provided with the development device of the present invention.

FIG. 2 is an overall arrangement view of the color image forming apparatus having a developing device of the present invention which is a preferable developing means.

In FIG. 2, numeral 1 is a photoreceptor belt, which is a belt-shaped image forming body composed of a flexible belt on which a photoconductor is coated or vapor-deposited. This photoreceptor belt 1 is provided between the rotational rollers 2 and 3. When the rotational roller 2 is driven, the photoreceptor belt 1 conveyed clockwise in the drawing.

Numeral 4 is a guide member which is fixed to the apparatus body for guiding the photoreceptor belt 1, wherein the guide member 4 is arranged being inscribed in the photoreceptor belt 1. When tension is given to the photoreceptor belt 1 by the action of a tension roller 5, the internal surface of the photoreceptor belt 1 is slidably contacted with the guide member 4.

Numeral 6 is a scorotron type charging unit. Numeral 7 is an exposure means, that is, numeral 7 is a laser beam writing unit which conducts a writing operation (an exposing operation) with laser beams. Numeral 8A to 8D are a plurality of developing means in which developers of specific colors are accommodated. This developing means is the developing unit of the present invention. These developing units are disposed in the position where the guide member 4 comes into contact with the photoreceptor belt 1.

The developing units 8A, 8B, 8C, 8D will be described in detail later. The developing units 8A, 8B, 8C, 8D accommodate developers of yellow, magenta, cyan and black. Each developing unit is provided with a developing sleeve 81 which is disposed in such a manner that a predetermined clearance is provided between the developing sleeve 81 and the photoreceptor belt 1, so that a latent image formed on the photoreceptor belt 1 can be made visual by means of reversal development under a non-contact condition. This non-contact developing method is advantageous in that the movement of the photoreceptor belt is not obstructed, which is different from a contact-developing method.

Numeral 12 is a transfer unit. Numeral 13 is a cleaning unit. While an image is being formed, a blade 13*a* of the cleaning unit 13 and a toner conveyance roller 13*b* are separated from the surface of the photoreceptor belt 1, and only in the process of cleaning conducted after the image has been transferred, the blade 13*a* and the toner conveyance roller 13*b* are contacted with the surface of the photoreceptor belt 1 with pressure as illustrated in the drawing.

The process of color image formation is carried out by the above color image forming apparatus as follows.

In this example, a multicolor image is formed according to the following image formation system.

(1) Color image data is obtained by the image data input section in which an original image is scanned by an image pick-up element.

(2) The thus obtained data is processed by the image data processing section, so that image data is made.

(3) The image data is temporarily stored in the image memory.

(4) In the process of recording, this image data is called and inputted into the color image forming section illustrated in FIG. 2 which is a recording section.

When image data of each color outputted from an image reading unit provided separately from the aforementioned color image forming apparatus, is inputted into laser beam writing unit 7, laser beams (writing light beams), generated by a laser diode not shown, pass through a collimator lens and a cylindrical lens not shown and are subjected to rotary scanning by a rotary polygonal mirror 74 rotated by a drive motor 71, and then laser beams pass through an fθ lens 75 and a cylindrical lens 76 while the optical path of laser beams is curved by mirrors 77 and 78, and laser beams are projected on the circumferential surface of the photoreceptor belt 1 on which a uniform electrical charge is previously given by the scorotron charger 6, so that primary scanning is carried out and a bright line is formed.

When scanning is started, the laser beams are detected by an index sensor not shown in the drawing. Laser beams modulated according to the image data of the first color scan the circumferential surface of the photoreceptor belt 1. Consequently, a latent image corresponding to the first color is formed on the circumferential surface of the photoreceptor belt 1 by the action of primary scanning conducted by laser beams and auxiliary scanning conducted by the conveyance of the photoreceptor belt 1. This latent image is developed by a developing unit 8A loaded with yellow (Y) toner, so that a toner image is formed on the circumferential surface of the photoreceptor belt 1. While the obtained toner image is held on the surface of the photoreceptor belt 1, it passes below the cleaning unit 13 which has been separated from the circumferential surface of the photoreceptor belt 1. Then, the process advances to the next image forming cycle.

That is, the photoreceptor belt 1 is charged again by the charging unit 6, and image data of the second color outputted from the image data processing section is inputted into the laser beam writing unit 7, and then the image data of the second color is written onto the circumferential surface of the photoreceptor belt 1 in the same manner as the first color so that a latent image of the second color is formed. The latent image is developed by the developing unit 8B loaded with magenta (M) toner.

The magenta (M) toner image is formed under the presence of the yellow (Y) toner image that has already been formed.

Numeral 8C is a developing unit provided with cyan (C) toner, and a cyan (C) toner image is formed on the belt surface in the same manner as that of the first and second colors.

Numeral 8D is a developing unit provided with black toner, and a black toner image is formed and superimposed on the belt surface in the same manner. DC bias and/or AC bias is impressed upon each developing sleeve 81 of the developing units 8A, 8B, 8C and 8D, and noncontact developing is conducted by two-component developer which is an image visualizing means, so that the toner image on the photoreceptor belt 1, the base of which is grounded, is developed under a noncontact condition.

High voltage, the polarity of which is reverse to that of toner, is impressed upon the color toner image formed on the circumferential surface of the photoreceptor belt 1, and the toner image is transferred in the transfer section onto a transfer sheet which has been sent from a sheet feed cassette 14 through a sheet feed guide 15.

That is, the uppermost transfer sheet in the sheet feed cassette 14 is conveyed out from the sheet feed cassette 14 by the rotation of the sheet feed roller 16, and sent to the transfer unit 12 through a timing roller 17 in synchronization with image formation conducted on the photoreceptor belt 1.

The transfer sheet onto which a toner image is transferred is positively separated from the photoreceptor belt 1, the conveyance direction of which is sharply changed when it is rotated around the rotational roller 2. Then, the transfer sheet is conveyed upward. After that, the image on the photoreceptor belt 1 is fixed by a fixing roller 18, and discharged onto a tray 20 by a discharge roller 19.

After the image has been transferred onto the transfer sheet, the photoreceptor belt 1 is further rotated, and residual toner on the belt is removed by the cleaning unit 13, the blade 13*a* and the toner conveyance roller 13*b* of which are contacted with the surface of the belt with pressure. After the cleaning operation has been completed, the aforementioned blade 13*a* is separated again from the belt surface, and a little after that, the toner conveyance roller 13*b* is separated, and then a new image forming process is started.

In this embodiment of the present invention, the color image forming apparatus includes a belt type image forming body, however, it should be noted that the present invention can be applied to a color image forming apparatus including a drum type image forming apparatus.

EXAMPLE 1

Figure 1:
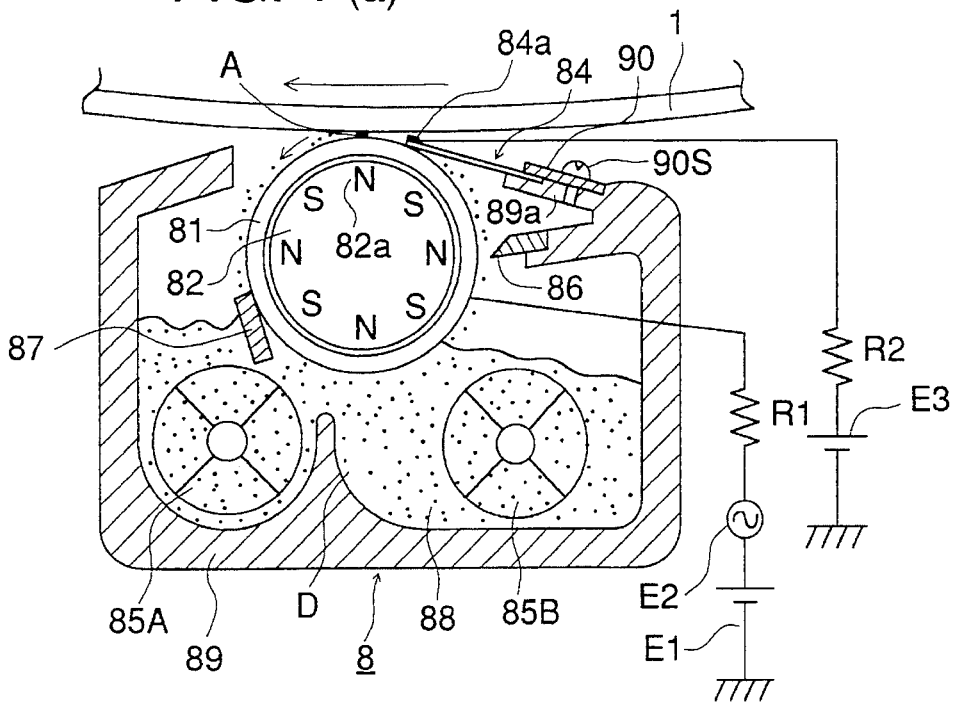
FIGS. 1(*a*) to 1(*c*) are sectional views showing an outline of the example of the developing apparatus of the present invention.
Figure 1:
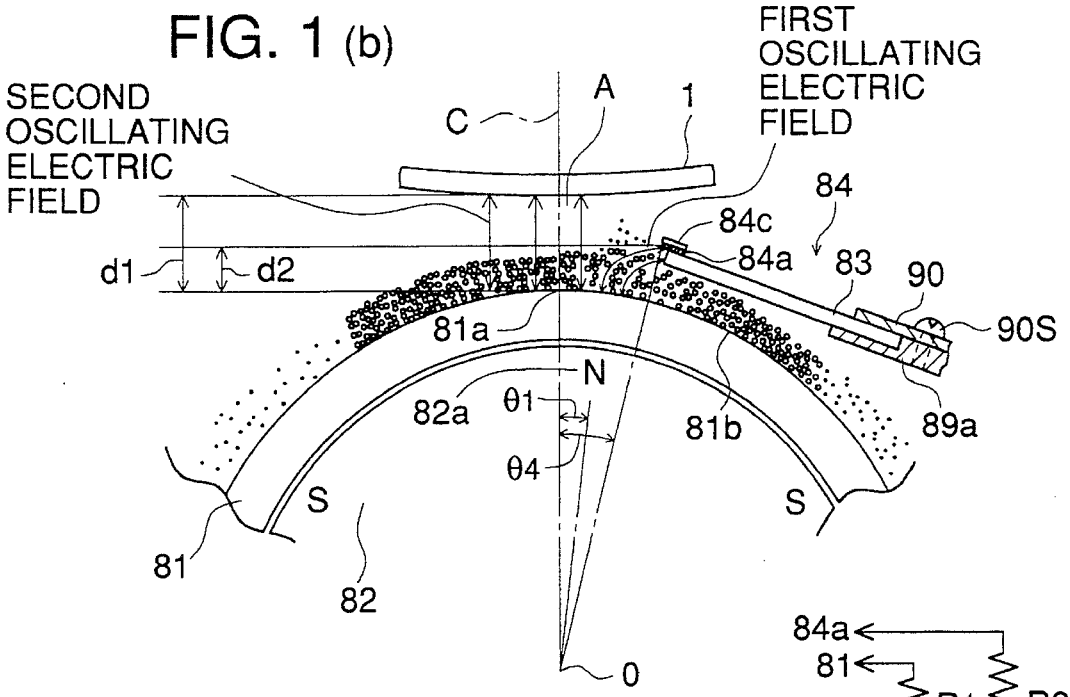
Figure 1:
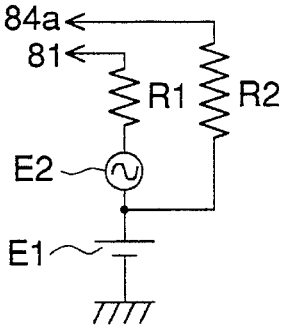

FIG. 1(*a*) is a sectional view showing an outline of the example of the developing apparatus of the present invention.

FIG. 1(*a*) is a sectional view showing an outline of the example of the developing apparatus of the present invention. FIG. 1(*b*) is an enlarged view of the primary portion. FIG. 1(*c*) is a view showing another example of the bias voltage source. Numeral 81 is a development sleeve made of non-magnetic material such as aluminum, and this development sleeve functions as a developer conveying body. The development sleeve is capable of rotating in the arrowed direction shown in the drawing. Numeral 82 is a magnetic body attached inside the development sleeve 81, and the magnetic body 82 is provided with a plurality of magnetic poles of N and S in the circumferential direction. One 82*a* of the magnetic poles of the magnet body 82 is arranged in the development region A where a distance from the development sleeve 81 to the photoreceptor belt 1 is shortest, and this magnetic pole 82*a* is referred to as a primary magnetic pole in this specification, hereinafter. Developer conveying function is exerted by the development sleeve 81 and the magnet body 82. Each magnetic pole of the magnet body 82 including the primary magnetic pole 82*a* is magnetized to the magnetic flux density of 500 to 1500 gauss. By the magnetic force described above, a layer of magnetic developer D is formed on the development sleeve 81, that is, a magnetic brush is formed. When the development sleeve 81 is rotated, this magnetic brush is moved in the same direction, so that the magnetic brush is conveyed to the development region A. A clearance between the development sleeve 81 and the regulation blade 86, and a clearance between the development sleeve 81 and the photoreceptor belt 1 are adjusted so that the magnetic brush thus formed on the development sleeve 81 can not be contacted with the surface of the photoreceptor belt 1, that is, an appropriate clearance can be maintained between the magnetic brush and the photoreceptor belt 1.

Numeral 84 is a control electrode including an insulating member 83 which comes into contact with the developer D layer, an electrode 84*a* upon which a voltage is impressed, and an overhang member mounted on the electrode 84*a*. Examples of electrically insulating materials used for the insulating member 83 are: polyester, polyimide, glass epoxy, polyethylene terephthalte, and polyamide imide. This insulating member also functions as a leveling member to level the developer. The electrode 84*a* is made of conductive material such as metal. The electrode 84*a* is integrally mounted on an end of the insulating member 83. The overhang member 84*c* is composed of a plate made of glass epoxy. Numerals 85A, 85B are agitating screws for agitating the developer D so that the composition can be made uniform. Numeral 86 is a regulation blade made of non-magnetic or magnetic material, which is a developer regulation means for regulating the height and volume of the magnetic brush. Numeral 87 is a cleaning blade for removing the residual magnetic brush from the surface of the development sleeve 81 after the magnetic brush has passed through the development region A. Numeral 88 is a developer reservoir. Numeral 89 is a casing. Numeral 89*a* is a support portion attached to the casing 89 for supporting the insulating member 83. Numerals 90, 90*s* are respectively a fixing plate and a fixing screw for fixing the control electrode 84 to the support portion 89*a*.

Figure 3:
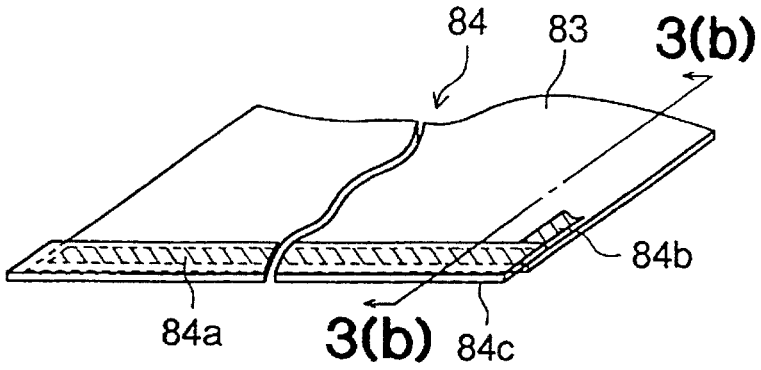
FIG. 3(*a*) is a perspective view showing an example of the control electrode.
Figure 3:
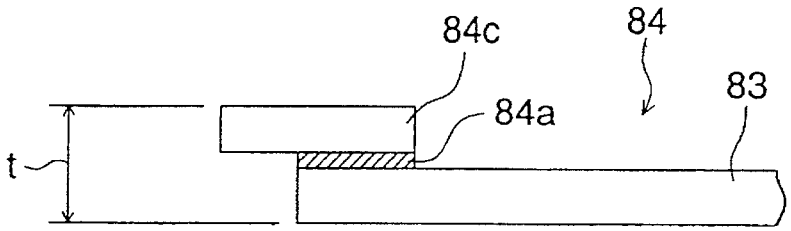

FIGS. 3(*a*) and 3(*b*) are respectively a perspective view and a sectional view showing an example of the control electrode 84. The electrode 84 illustrated in FIGS. 3(*a*) and 3(*b*) are composed in the following manner. The electrode portion 84*a* is formed at an end of the insulating member 83 by the printed board manufacturing method of the prior art. In this case, glass epoxy, polyimide or paper phenol is used as the insulating member 83. The insulating member 83 is laminated on a conductive member such as copper foil. Then the etching processing is conducted, so that the electrode 84*a* is formed at the end of the insulating member 83. Further, a hangover member 84*c* composed of a glass epoxy plate covers the electrode 84*a*. In this case, the hangover member 84*c* is integrally adhered onto the electrode 84*a* in such a manner that the hangover member 84*c* protrudes from the electrode 84*a*.

Figure 4:
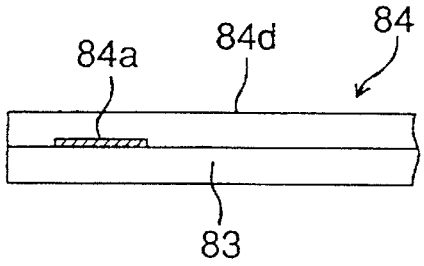
FIG. 4 is a sectional view showing another example of the control electrode.

FIG. 4 is a sectional view showing another example of the control electrode 84. In this case, the control electrode 84 includes an insulating member 83, a hangover member 84*d* of which the size is the same as that of the insulating member 83, and an electrode 84*a* interposed between the insulating member 83 and the hangover member 84*d*, wherein the fore end of the electrode 84*a* is distant from the ends of other members by about 0.3 mm. Further, the electrode 84*a* is covered with a cover member 84*d* made of insulating material such as glass epoxy. In this case, the width of the cover member 84*d* is twice as long as that of the electrode 84*a* in the circumferential direction, and the cover member 84*d* is integrally adhered onto the electrode 84*a*.

It is possible to use a control electrode having no hangover members 84*c*, 84*d*. However, it is preferable to use the control electrode having the hangover member 84*c*, because the electrode 84*a* can be prevented from being stained when the hangover member 84*c* is attached.

Figure 5:
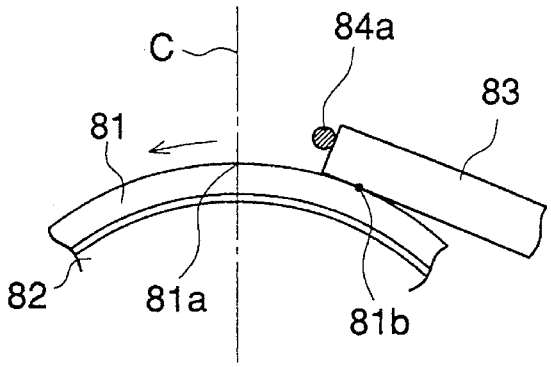
FIGS. 5(*a*) to 5(*h*) are sectional views showing other examples of the insulating member and the electrode portion of the control electrode.
Figure 5:
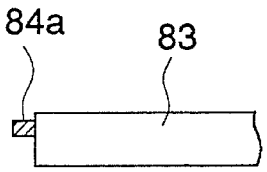
Figure 5:
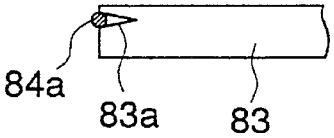
Figure 5:
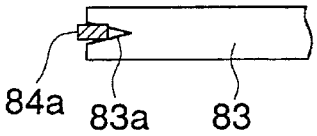
Figure 5:
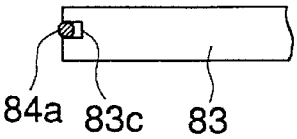
Figure 5:
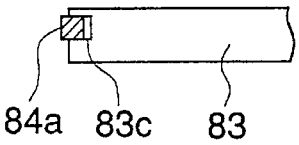
Figure 5:
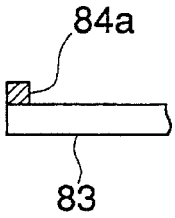
Figure 5:
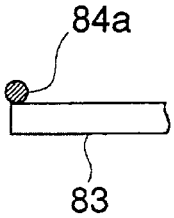

As illustrated in the drawings, the electrode 84*a* may be attached in the following various manners. As shown in FIGS. 5(*a*), 5(*b*), 5(*g*) and 5(*h*), the electrode 84*a* is composed of a member made of conductive material such as metal, the section of which is circular or rectangular, and the member is adhered to the fore end of the insulating member 83 with adhesive. Alternatively, a notch portion 83*a* is formed at the fore end of the insulating member 83 as illustrated in FIGS. 5(*c*) and 5(*d*), and the electrode 84*a* is interposed in the notch portion 83*a*. Alternatively, a recess 83*c* is formed at the fore end of the insulating member 83, and the electrode 84*a* is embedded in the recess 83*c* as illustrated in FIGS. 5(*e*) and 5(*f*). The electrode 84*a* may be coated with insulating resin for the purpose of preventing useless discharge and also for the purpose of preventing rust.

In order to prevent the generation of unnecessary clouds so as to convey the developer stably, the overall electrode 84*a* is arranged in the following manner. As shown in FIG. 1(*b*), the electrode 84*a* is not arranged on the side close to a point at which a distance between the insulating member 83 and the development sleeve 81 is shortest, but arranged on the side close to a point at which a distance between the development sleeve 81 and the photoreceptor belt 1 is shortest. Length of the electrode 84*a* in the circumferential direction is determined depending on the conveyance speed of the development sleeve 81, however, it is preferable that the length of the electrode 84*a* in the circumferential direction is 0.05 to 5 mm, and it is more preferable that the length of the electrode 84*a* in the circumferential direction is 0.1 to 1 mm. When the length is shorter than 0.05 mm, it is impossible to generate a sufficient amount of clouds. When the length is longer than 5 mm, toner is electrically charged due to the vibration, so that toner is over-charged and the development property is lowered.

Concerning the thickness t of the control electrode 84 shown in FIG. 3, when the shortest distance between the photoreceptor belt 1 in the development region A and the development sleeve 81 is $d_1$, it is preferable that the thickness is $(1/10000)d_1$ to $(2/3)d_1$, and it is more preferable that the thickness is $(1/1000)d_1$ to $(2/3)d_1$. When the thickness is larger than $(2/3)d_1$, a clearance between the photoreceptor belt 1 and the hangover members 84*c*, 84*d* is reduced, or a clearance between the photoreceptor belt 1 and the electrode 84*a* is reduced. Accordingly, the hangover members 84*c*, 84*d* tend to come into contact with the surface of the image forming body 1, or the electrode 84*a* tends to come into contact with the surface of the image forming body 1. Accordingly, blur of images tends to occur. On the contrary, when the thickness t is smaller than $(1/10000)d_1$, an electric current tends to flow from the development sleeve 81, so that a voltage drop occurs and the development property is lowered.

Figure 6:
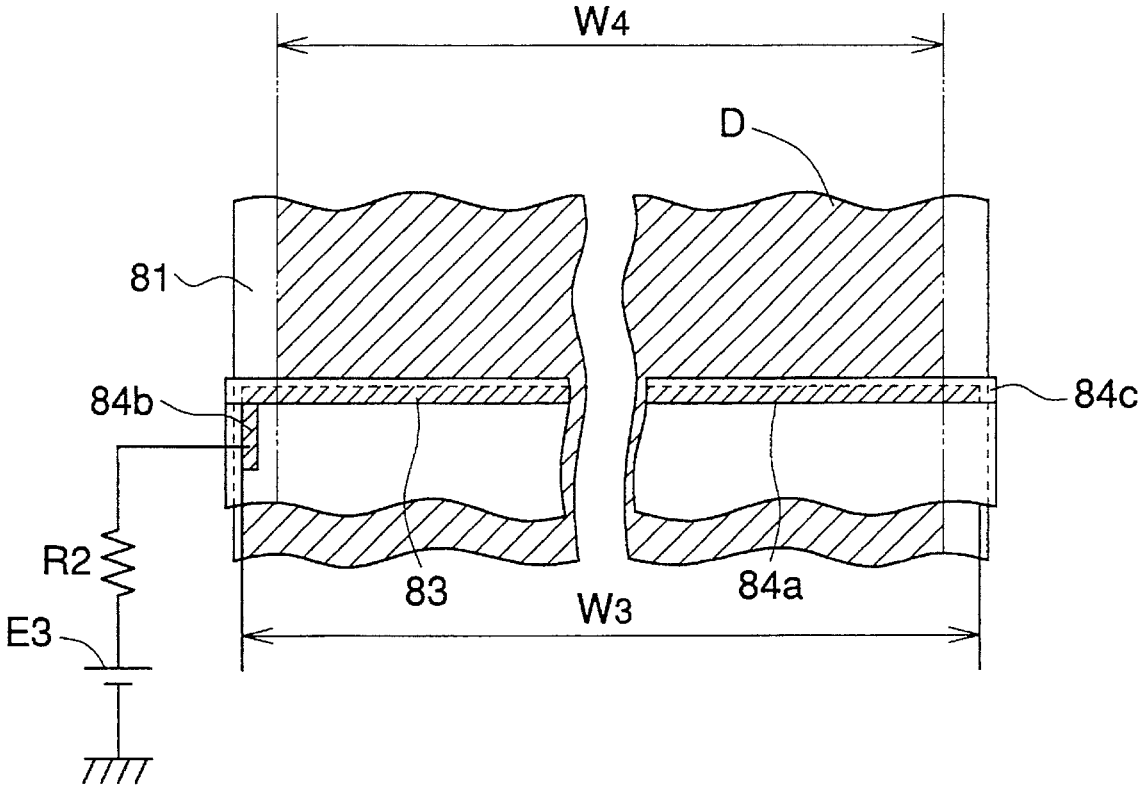
FIG. 6 is a plan view showing a relation between each portion of the control electrode and the width of the developing sleeve.

When the width of the electrode 84*a* (the length of the development sleeve 81 in the axial direction) is $W_3$, and when the width of the development region on the development sleeve 81 (the width of the developer D layer) is $W_4$, under the condition that the inequality $W_3>W_4$ as illustrated in FIG. 6, a terminal 84*b* through which the DC voltage $E_3$ is impressed upon the electrode 84*a* is arranged outside of the width $W_4$ of the development region, so that the generation of unnecessary toner clouds can be prevented.

When the surface roughness $R_{z1}$ (μm) of the development sleeve 81 and the surface roughness $R_{z2}$ (μm) of the surface opposed to the development sleeve 81 satisfy the inequality of $R_{z2} \geqq R_{z1}$, the conveyance of developer conveyed onto the development sleeve 81 is obstructed, so that an amount of toner conveyed to the development region A is reduced, which lowers the image density. In order to obtain a high conveyance property and a high quality image without blur, it is preferable that $R_{z1}$ is in the range from 0.2 to 20 μm, and $R_{z2}$ is in the range from 0.02 to 5.0 μm. In this connection, the measurement of surface roughness $R_z$ was conducted in accordance with JIS B 0601, and surface roughness meter Surftest-402 manufactured by Mitsutoyo Co. was used under the condition that the reference length was 25 mm.

As illustrated in FIG. 1(*b*), the position at which the control electrode 84 is arranged is determined as follows. The position at which the control electrode 84 is arranged is located in the development region A or in the upstream of the development region A with respect to the rotation of the development sleeve 81. Angle $\theta_1$ is defined as an angle formed between a straight line connecting the rotational center O of the development sleeve 81 with the closest position 81*a* of the development sleeve 81 to the photoreceptor belt 1, and a straight line connecting the rotational center O of the development sleeve 81 with the primary magnetic pole 82*a*. Angle $\theta_4$ is defined as an angle formed between a straight line connecting the rotational center O of the development sleeve 81 with the closest position 81*a* of the development sleeve 81 to the photoreceptor belt 1, and a straight line connecting the fore end of the hangover member 84*c* of the control electrode 84. In FIG. 1, reference character C is a center line connecting the closest position 81*a* with the rotational center of the development sleeve 81. The value of angle θ is positive in the upstream with respect to the closest position 81*a*, and negative in the downstream with respect to the closest position 81*a*. When the following inequality is satisfied, $$-10° \leqq \theta_1 \leqq 10°$$

$$(\theta_1-5°) \leqq \theta_4 \leqq (\theta_1+5°)$$

bristles of developer D in the developing region A are excellently formed, so that the development efficiency can be maintained high and toner is prevented from scattering.

When the value of $\theta_1$ is lower or higher than 10°, the bristles of developer D in the development region A are not sufficiently formed, so that the development property is deteriorated.

When the value of $\theta_4$ is lower than $(\theta_1-5°)$, the control electrode 84 excessively covers the bristles of developer D, so that the development property is deteriorated.

When the value of $\theta_4$ is higher than $(\theta_1+5°)$, the bristles of developer D are excessively formed. Therefore, developer D comes into contact with the photoreceptor on the photoreceptor belt 1, and carrier particles of developer D are deposited on the photoreceptor belt 1, so that the formed image blurs.

As described above, in this embodiment, the primary magnetic pole 82*a* is disposed in the development region A, and the control electrode 84 is arranged close to the development region A and comes into contact with the developer conveyer 81 or comes close to the developer conveyer 81. Due to the foregoing, the bristles of developer D are appropriately formed and carrier particles are not deposited. As a result, it is possible to realize the enhancement of development property by impressing a low development bias voltage. Conventionally, it was impossible to improve the development property by impressing a low development bias voltage. In this example, the development property was improved under the following condition.

$$d1=0.5 \text{ mm}, d2=0.25 \text{ mm}, \theta_1=1°, \text{ and } \theta_4=2°$$

In this case, $d_2$ is a height mm of the electrode 84*a* from the development sleeve 81. From the viewpoint of prevention of discharge to the development sleeve and the image forming body and also from the viewpoint of improving the development property, it is preferable that $d_2$ is (0.2 to 0.6)$d_1$.

In the above example, a bias voltage is impressed upon the development sleeve 81 through the protective resistance $R_1$. In this case, in the bias voltage, AC component is superimposed on DC component. Beside, a bias voltage composed of only DC component is impressed upon the electrode 84*a* from the DC bias power source $E_3$ through the protective resistance $R_2$. From the viewpoint of prevention of deposition of toner, it is preferable that a DC voltage, the polarity of which is the same as that of toner, is impressed upon the electrode 84*a*.

When the DC voltage impressed upon the development sleeve 81 is the same as the DC voltage impressed upon the electrode 84*a*, as shown in FIG. 1(*c*), it is possible to use the DC bias power source $E_1$ in common. In this way, the construction of the apparatus can be simplified.

In the developing unit 8 of the present invention, when the bias voltage described above is impressed, an alternating electric field (referred to as the second oscillating electric field) is generated between the photoreceptor belt 1 and the development sleeve 81, and at the same time, the first oscillating electric field is generated between the electrode 84*a* of the control electrode 84 and the development sleeve 81.

In the above color image forming apparatus, an OPC photoreceptor to be negatively charged is used for the photoreceptor of the photoreceptor belt 1, and reversal development is conducted. For example, when the photoreceptor is charged at −850 V, a bias voltage of DC −750 V is impressed upon the electrode 84*a*, and a bias voltage in which DC −750 V and an AC voltage are superimposed are impressed upon the development sleeve 81. In this case, the frequency of the AC component is 100 Hz to 20 kHz and preferably 1 kHz to 10 kHz, and the zero-peak voltage ($V_{0-p}$), which is ½ of the peak-peak voltage of ($V_{p-p}$), will be described later. In this case, it is preferable that the following inequality is satisfied.

$$20 \cdot Q \cdot d_t \cdot d_1 > V_{0-p} > 3 \cdot Q \cdot d_t \cdot d_2$$

where the shortest distance between the image forming body 1 and the developer conveyer 81 is $d_1$ (mm), the height of the electrode 84*a* from the development sleeve is $d_2$ (mm), the average sphere equivalent diameter of toner in the developer is $d_t$ (μm), and the average charge of toner is Q (μC/g). Further, it is preferable that the following inequality is satisfied.

$$10 \cdot Q \cdot d_t \cdot d_1 > V_{0-p} > 5 \cdot Q \cdot d_t \cdot d_2$$

In this case, the electrode 84*a* is arranged closer to the development sleeve 81 than the photoreceptor belt 1 is. Accordingly, the intensity of the first oscillating electric field is higher than the intensity of the second oscillating field.

Toner particles of developer D, which have arrived at positions close to the electrode 84*a*, are oscillated by the first oscillating electric field in the direction perpendicular to the lines of electric force of the first oscillating electric field. Accordingly, the toner particles are separated from the carrier particles and scattered so as to sufficiently generate toner clouds. These toner clouds are further scattered to the latent image on the photoreceptor belt 1 by the second oscillating electric field. Therefore, development is uniformly conducted.

Since the AC bias voltage is impressed upon only the development sleeve 81 in this case, the phase of the first oscillating electric field becomes the same as the phase of the second oscillating electric field. Therefore, the toner particles are smoothly transferred from the first oscillating filed to the second oscillating field.

The waveform of the AC component is not limited to a sine wave, but the waveform of the AC component may be a rectangular wave or a triangular wave. Depending upon the frequency, the higher the voltage is, the more the magnetic brush of developer D is oscillated, so that the toner particles are more smoothly separated from the carrier particles and scattered. On the other hand, when the voltage is raised, fog and breakdown such as lightning tend to occur. In this case, the occurrence of fog can be prevented by the DC component, and the occurrence of dielectric breakdown can be prevented when the surface of the development sleeve 81 is coated with resin or oxide film so that the development film can be insulated. Further, the occurrence of dielectric breakdown can be prevented when insulating carrier particles are used for the developer D, the detail of which will be described later.

Next, an amount of conveyance of developer D will be described as follows.

In the examples described above, it is preferable that the amount of conveyance of developer D on the development sleeve 81 satisfies the following condition.

In this case, the following expression is established.

$$D_T = \frac{3\sqrt{3} \cdot D_{ws} \cdot T_c \cdot vs}{10 \cdot \pi \cdot dt \cdot \rho t \cdot vp}$$

where the reference characters are defined as follows.

$D_{ws}$: Amount of conveyed developer on the developer conveyer in the development region (mg./cm$^2$)

$T_c$: Concentration of toner in the developer (%)

$d_t$: Average sphere equivalent diameter of toner in the developer (μm)

$\rho_t$: Density of toner in the developer (g/cm$^3$)

$v_s$: Speed of the developer conveyer in the development region (mm/s)

$v_p$: Speed of the image forming body in the development region (mm/s)

In the above expression, $D_T$ is a number of toner layers on the assumption that the toner particles passing through the development region are filled most densely. When the coefficient is 1, the toner passing through per unit area is the densest, and the toner, the number of which corresponds to one layer, passes through. The higher the coefficient is, the number of toner particles passing through is increased. When the development efficiency is 100%, it is sufficient that the coefficient is 1. However, actually, the development efficiency is approximately 50%, so that the coefficient must be high. In this case, the toner weight is not used. Therefore, it is possible to apply the coefficient to a case in which magnetic toner (toner of high specific gravity) is used.

The value of $D_T$ is in a range from 1.5 to 9.

In the case of $D_T<1.5$, an amount of toner to be conveyed is so small that the development property is deteriorated.

In the case of $D_T>9$, an amount of toner is increased too high, so that the reproducing property of gradation is lowered. In the case described above, an excessively large amount of toner is conveyed. Therefore, fog tends to occur. Further, in order to obtain an appropriate image density, it is necessary to reduce the development efficiency. Due to the foregoing, toner particles of large size, which tend to be developed, are developed, and toner particles of small size, which is difficult to be developed, accumulate in the developer. Accordingly, the development property is deteriorated when the development operation is continued over a long period of time, that is, what is called "selective development" is caused. In the process of transfer and fixation, toner is consumed. Accordingly, in order to improve the reproducibility of gradation, it is preferable that the value of $D_T$ is maintained in a range from 2.5 to 7.5.

Figure 7:
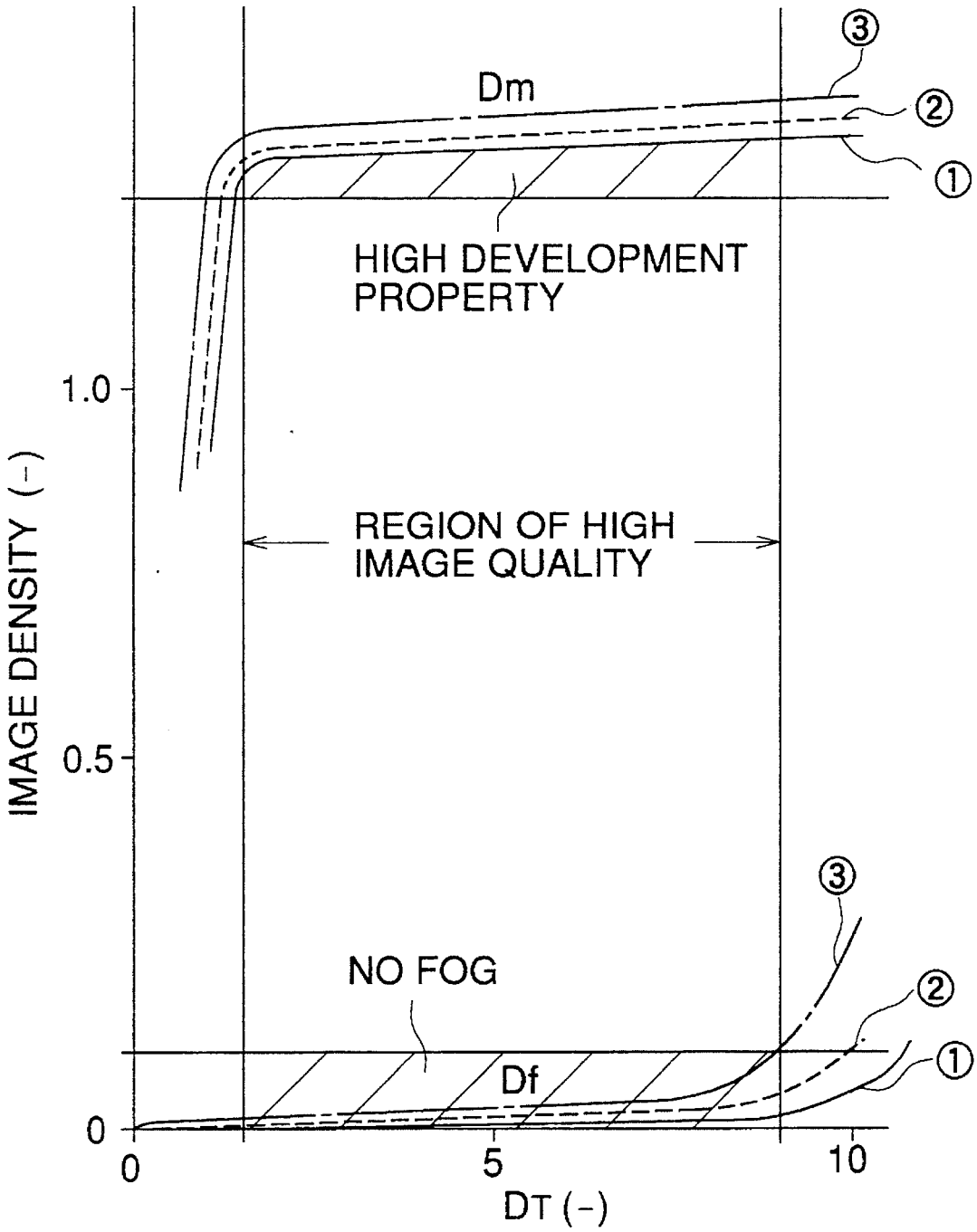
FIG. 7 is a graph showing a preferable region of the value of $D_T$.

FIG. 7 is a graph showing a relation between $D_T$ and the maximum image density $D_m$, and also showing a relation between $D_T$ and the image density $D_f$ of the background portion. In this case, the developing apparatus (shown in FIG. 1) of the example 1a, the developer and the color image forming apparatus (shown in FIG. 2) were used. As described above, $D_T$ was changed when a clearance between the developer regulating member 86 and the developer conveying body 81 was adjusted. This result was obtained when the measurement was conducted under the following condition. Only, the black developing unit 8D in the image forming apparatus shown in FIG. 2 was used. Development was conducted with black toner by the maximum voltage (−850 V in the non-exposed portion) and the minimum voltage (−50 V in the exposed portion) on the image forming body. The formed image was transferred onto a transfer sheet by means of corona discharge, and the transferred image was thermally fixed by the heat roller. Density of the thus obtained image was measured by the image density meter (Macbeth density meter RD918 manufactured by Macbeth Co.). In general, it is necessary that the image density in an exposed portion, which is an image portion, is not less than 1.3. When the image density is lower than 1.3, it is judged that the development property is not good. In general, it is necessary that the image density in an unexposed portion, which is a non-image portion, is not more than 0.1. When the image density is higher than 0.1, it is judged that fog on the image is excessively high. As shown in the drawing, it can be understood that an image of high density having no fog was provided when $D_T$ was in a range from 1.5 to 9.

In this case, the zero-peak voltage ($V_{0-p}$) is preferably in the following range.

$$20 \cdot Q \cdot d_t \cdot d_1 > V_{0-p} > 3 \cdot Q \cdot d_t \cdot d_2$$

where the shortest distance between the image forming body 1 and the developer conveyer 81 is $d_1$ (mm), the height of the electrode 84*a* from the development sleeve is $d_2$ (mm), the average sphere equivalent diameter of toner in the developer is $d_t$ (μm), and the average charge of toner is Q (μC/g). Further, it is preferable that the following inequality is satisfied.

$$10 \cdot Q \cdot d_t \cdot d_1 > V_{0-p} > 5 \cdot Q \cdot d_t \cdot d_2$$

When the AC voltage to be impressed is too high and exceeds this range, electric discharge is caused between the developer conveyer and the control electrode. As a result, it is impossible to obtain an image of high quality, and further the control electrode tends to be damaged. When the AC voltage to be impressed is too low and exceeds this range, the intensity of the electric field formed between the developer conveyer and the control electrode is extremely weakened. As a result, it is impossible to obtain a sufficiently high development property. When $D_T$ is in the range from 1.5 to 9 and the AC voltage to be impressed is in the above range, it is possible to obtain a high development property, and am the same time occurrence of fog can be prevented as illustrated in FIG. 7.

In FIG. 7, (1) represents a case of the peak voltage of $130V_{0-p}$, (2) represents a case of $800V_{0-p}$, and (3) represents a case of $1600V_{0-p}$. It is preferable that the frequency component is 100 Hz to 20 kHz, and it is more preferable that the frequency component is 1 kHz to 10 kHz. In this connection, the DC component impressed upon the developer conveyer 81 and the electrode 84*a* is −750V which is the same as that of Example 1a. Of course, the circumstances are the same as those of the developing units except for black.

In order to adjust an amount of conveyance of developer D, a developer amount regulating member of the prior art is arranged in the upstream of the contact-point/close-point of the control electrode 84 to the development sleeve 81. Examples of the usable regulating members are: an elastic blade type in which an elastic body such as rubber is pressed against the layer of developer D; a type in which a magnetic member made of magnetic stainless steel is pressed against the layer of developer D by the action of the magnet 82 provided in the development sleeve 81; and a type in which the bristles of developer are regulated by the non-magnetic blade (the regulating blade 86 shown in FIG. 1) arranged being opposed to the magnetic body 82 in the development sleeve 81, wherein a predetermined clearance is maintained between the non-magnetic blade and the sleeve 81 of developer D. In the present invention, it is preferable to use the type in which the bristles of developer are regulated by the non-magnetic blade and the developer conveyance amount can be relatively easily controlled by changing a clearance between the blade and the sleeve 81 of developer D.

A speed ratio vs/vp of the development sleeve 81 and the image forming body is adjusted by changing the rotational speed of the development sleeve 81.

The measurement method of $D_{ws}$ (mg/cm$^2$), which is an amount of developer conveyance per unit area is described as follows. Developer D on the development sleeve 81 is adhered onto an adhesive tape, the weight of which is previously measured. A difference between the weight before and after the adhesion of developer D is divided by the area of the adhesive tape.

According to the developing apparatus of the present invention, images of high quality are formed in the following manner:

Two-component developer is maintained in a non-contact condition with the photoreceptor belt 1 which is an image forming body. Toner clouds are generated by the actions of the first and second oscillating electric fields, so that toner particles are separated and scattered toward the photoreceptor belt and selectively attracted onto an electrostatic image. In this way, carrier particles are prevented from adhering onto the photoreceptor belt 1. Accordingly, fine particles of toner and carrier can be used. In this way, high image quality can be accomplished. In the developing apparatus of the present invention, it is preferable that developer D composed of the following carrier and toner particles is used.

In general, when the average particle size of magnetic carrier particles is large, the bristles of the magnetic brush formed on the development sleeve 81 becomes rough. Therefore, even when an electrostatic latent image is developed while oscillation is given by the electric filed, unevenness tends to occur on the toner image, and the toner concentration in the bristles is lowered, so that development of high concentration is difficult to be accomplished. In order to solve the above problems, it is necessary to reduce the average particle size of magnetic carrier particles. As a result of the experiment made by the inventors, it is preferable that the volume average particle size is 10 to 60 μm, and it is more preferable that the volume average particle size is 20 to 50 μm. However, when it is not more than 10 μm, it is difficult to sufficiently magnetize carrier particles. As a result, carrier particles are deposited on the surface of the photoreceptor belt 1 together with toner particles, and further they tend to scatter. When it is not less than 60 μm, the specific surface area of the carrier particle is reduced. Accordingly, it is difficult to sufficiently charge the toner, and further toner particles tend to scatter.

The volume average particle size is measured by the laser beam diffraction type particle size measurement device "HEROS" manufactured by SYMPATEC Co which provided with a wet type dispersion device. First, several tens mg of magnetic particles are dispersed in 50 mg of water together with a surface active agent by the wet type dispersion device. Next, using an ultrasonic homogenizer (the capacity: 150 W), dispersion processing is conducted for 1 to 10 minutes while consideration is given so as to avoid the occurrence of coagulation by the generated heat.

The intensity of magnetization of carrier particles is 5 to 60 emu/g, and it is preferable that the intensity of magnetization of carrier particles is 10 to 40 emu/g. When the magnetic flux density on the development sleeve 81 is 500 to 1200 gauss, which is a common value, the intensity of magnetization of lower than 5 emu/g is not appropriate, because the magnetic restricting force is not sufficient so that carrier particles are scattered. When the intensity exceeds 60 emu/g, the height of bristles of carrier is excessively increased, so that it is difficult to maintain the non-contact condition with the photoreceptor belt 1.

In this case, the intensity of magnetization of carrier can be measured in the following manner:

Carrier particles are charged into a sample cell, the dimensions of which are 0.25 cm×3 cm$^2$, while tapping is being conducted. After that, the sample is attached to a pickup coil and set at a magnetizer. Then, using the direct current magnetizing characteristic automatic recording device "TYPE3227" manufactured by Yokogawa Hokushin Denki Co., a hysteresis curve is drawn by the X-Y recorder. In this way, the intensity of magnetization is measured.

The magnetic carrier is described as follows: Examples of usable magnetic carrier materials are: metal such as iron, chrome, nickel and cobalt; chemical compounds or alloys of the above metals. For example, particles are used which are made of ferromagnetic materials or paramagnetic materials such as triiron tetroxide, γ-ferric oxide, chrome dioxide, manganese dioxide, ferrite, and manganese-copper alloy. Alternatively, the surfaces of the magnetic particles are coated with: styrene resin, vinyl resin, ethyl resin, rosin denatured resin, acrylic resin, polyamide resin, epoxy resin, polyester resin, silicon resin, and fluorine resin. These resins are coated in the form of blend or copolymer. It is possible to use a resin dispersion type carrier in which magnetic fine particles are dispersed in these resins. In this case, the shapes of carrier particles become unstable, so that the specific surface area is increased. Accordingly, a sufficient amount of toner necessary for development can be provided at a lower surface covering ratio. Therefore, toner particles are difficult to be scattered, which is preferable from the viewpoint of stability of development.

Next, toner particles will be explained as follows. In general, when the average particle size of toner particles is reduced, the electric charge is reduced in proportion to the square of the particle size, and an adhesive force such as Van der Waals force is relatively increased. Therefore, toner particles tend to scatter, so that fog tends to occur on an image. Further, toner particles are difficult to separate from the carrier particle of the magnetic brush. According to the conventional magnetic brush development method, the above problems become remarkable when the average particle size is not more than 10 μm. According to the present invention, the above problems are solved by conducting development with a magnetic brush in the double oscillating electric field. That is, toner particles attached to the bristles of a magnetic brush are strongly oscillated by the first oscillating electric field, so that the toner particles are easily separated from the bristles and toner clouds are formed. These toner clouds are conveyed to a near development region A by the inertia force generated by the sleeve rotation or the centrifugal force generated by the oscillating field, and then the toner particles are faithfully attracted by the electrostatic latent image in the second oscillating electric field. Since the electrode 84*a* is arranged only in the downstream of the closest point of the insulating member 83 and the development sleeve 81, toner clouds are not generated in the unnecessary portion except for the development region at this time. Further, toner particles of low electric charge are not unnecessarily moved to the image and non-image portions. Furthermore, toner particles are not rubbed by the photoreceptor belt 1. Accordingly, toner particles are not deposited on the photoreceptor belt 1 by triboelectricity. Therefore, it is possible to use toner particles of small size, for example, toner particles, the particle size of which is approximately 1 μm, can be used. When the connection between the toner and carrier particles are weakened by the oscillating electric field, deposition of carrier particles onto the photoreceptor belt 1 is reduced. When the bristles of the magnetic brush is not contacted with the surface of the photoreceptor belt 1, and also when toner particles having a higher electric charge than the carrier particles are selectively moved onto the electrostatic latent image in the oscillating electric field, deposition of carrier particles onto the photoreceptor belt 1 is greatly reduced.

As described before, when the average particle size of toner is increased, the formed image remarkably blurs. In order to provide a resolving power by which fine straight lines are aligned at the regular intervals of 10 pieces/mm, development may be conducted by toner, the average particle size of which is approximately 20 μm. However, when fine toner particles, the average particle size of which is not more than 10 μm, are used, the resolving power is remarkably enhanced and further the gradation can be faithfully reproduced, so that an image of high quality can be provided. However, when toner particles, the average particle size of which is not less than 20 μm, are used, the image quality is deteriorated, and when toner particles, the average particle size of which is not more than 1 μm, are used, toner particles are deposited onto carrier particles due to triboelectricity and further the covering ratio of carrier is increased. As a result, particles are not sufficiently charged and further they are scattered. From the reasons described above, it is preferable that the volume average particle size of toner is 1 to 20 μm, and it is more preferable that the volume average particle size of toner is 3 to 10 μm.

In this case, the volume average particle size is measured by the Coal Tar Counter TA-II (aperture: 100 m, manufactured by Coal Tar Co.).

It is preferable that the toner density $\rho_t$ is 1 to 2 (g/cm$^3$).

When the toner density $\rho_t$ is lower than 1, toner and carrier particles are not sufficiently mixed with each other, so that the toner charge becomes unstable, which causes fog and scatter.

When the toner density $\rho_t$ is higher than 2, when toner and carrier particles are agitated with each other, toner particles are fused to carrier particles, that is, what is called a toner-spent, which causes a failure of electric charge.

In order to measure the density, a dry type automatic density meter Accupyc 1330 manufactured by Micrometrics Co. is used.

When toner particles chase a change in the electric field, it is preferable that the absolute value of the average charge of toner particles is higher than 1 to 3 μC/g. More preferably, the absolute value of the average charge of toner particles is 3 to 50 μC/g from the viewpoint of the enhancement of development and the prevention of fog and scattering. Especially when the particle size is small, it is necessary that the electric charge is high.

The average charge Q of toner is measured as follows: An electric conductive plate of 2 cm×5 cm is opposed to the development roller, the diameter of which is 20 mm, wherein the closest distance from the electric conductive plate to the development roller is 0.7 mm. While developer is supplied to the development roller, it is rotated at the rotational speed of 200 rpm. During the rotation, a voltage in which DC and AC are superimposed (for example, DC: 1000 V, AC: 750 $V_{0-p}$, and AC frequency: 8 kHz) is impressed upon the development roller. Toner in the developer is developed on the electric conductive plate. The conductive plate on which toner has been developed is connected to the Faraday Gauge, and toner is blown away by nitrogen gas. The weight of toner thus blown away is measured, and the electric charge of toner thus blown away is also measured. From the weight and electric charge, the average charge Q can be calculated.

In this case, toner is manufactured by the following method:

Examples of resins used for manufacturing toner are: styrene resin, vinyl resin, ethyl resin, rosin denatured resin, acrylic resin, polyamide resin, epoxy resin, polyester resin, and sryrene-acryl resin. Further, the copolymers of these resins and the mixture are used. Color pigments, charge control agents and releasing agents such as wax are added to those resins. The thus obtained resin is subjected to the grinding granulation method, the suspension polymerization method, and the emulsion polymerization method. In this way, toner is manufactured. Magnetic or non-magnetic spherical toner particles and toner particles of an infinite shape, which are conventionally used, are selected by the average particle size selection means.

Concerning the preferable toner particles used in the development apparatus of the present invention, the summary of the characteristic is described as follows. Resins described before are used, and further magnetic fine particles are used. Color pigments and charge control agents, if necessary, are added to the resin, and toner particles are manufactured by the conventional toner particle manufacturing method. In this case, the volume average particle size is preferably not more than 20 μm, and more preferably 3 to 20 μm.

In the development apparatus of the present invention, it is preferable to use a developer in which the spherical carrier particles and toner particles described above are mixed by the same ratio as that of the conventional 2-component developer. In the case where common coating carrier (the density: 5 to 8 g/cm$^3$) is used, it is preferable that the toner concentration in the developer is 2 to 30 weight percent, and it is more preferable that the toner concentration in the developer is 5 to 20 weight percent.

When the toner concentration is lower than 2 weight percent, it is difficult to ensure the number of toner particles necessary for development. Further, the covering ratio is lowered, so that the electric charging is excessively conducted and the development property is deteriorated.

When the toner concentration is higher than 30 weight percent, the covering ratio is excessively increased, so that the electric charging is not appropriately conducted, and toner particles tend to scatter.

When the resin dispersion type carrier, the density of which is relatively low (2 to 4 g/cm$^3$), is used, the toner concentration in the developer is preferably set at a value a little higher than that of a case in which the common resin coated carrier is used, that is, the toner concentration in the developer is preferably set at 5 to 40 weight percent, and more preferably 10 to 30 weight percent.

The ratio $v_s/v_p$ in the above expression is 1 to 4, and preferably 1 to 2.5.

When the ratio is lower than 1, an amount of toner conveyed to the development region A is reduced, so that the development property is deteriorated.

When the ratio is higher than 4, toner is excessively supplied, so that an edge portion of the solid image, especially, a rear end portion of the image is developed under the condition of excessive toner, so that the bias is caused.

In order to avoid the generation of the bias, the ratio $v_s/v_p$ must be in a region higher than 1, and it is necessary that the ratio $v_s/v_p$ is close to 1 as possible. From the same reason, it is preferable that the developer conveyer and the image forming body are rotated in the same direction.

As long as a 2-component developer, the toner of which is magnetic, is used, a magnetic latent image can be made visual under the same development condition of the above example.

Using the color image forming apparatus illustrated in FIG. 2 to which the above development apparatus is attached, development was conducted. The photoreceptor belt 1 was an OPC photoreceptor, the circumferential speed of which was 180 mm/sec. The maximum voltage of the electrostatic latent image formed on the photoreceptor 1 was −850 V at the non-image portion. The minimum voltage was −50 V at the image portion. The outer diameter of the development sleeve 81 was 20 mm. The surface roughness was $R_{z1}$=1.2 μm. The magnetic intensity on the development sleeve surface was 70 gauss. $d_1$=0.5 mm. $\theta_1$=+1°. $\theta_4$=+2 °. The control electrode 84 was composed in such a manner that a glass epoxy plate of 0.1 mm thickness was used for the insulating member 83, and an electrode of 0.5 mm width in the circumferential direction was formed using a piece of copper foil of 0.02 mm thickness by the method of laminate etching as illustrated in FIG. 3(*b*), and further an overhang portion 84*c* composed of a glass epoxy plate was provided on it. The surface roughness of the insulating member 83 was $R_{z2}$=0.08 μm on the developer conveyer side. Concerning the developer regulating member, the regulating blade 86 illustrated in FIG. 1 was used, which was a regulating plate type to regulate the bristles of developer.

Concerning the developer D, the quantities of carrier and toner were adjusted so that the toner concentration shown on Table 2 could be provided. In this connection, toner concentration was a toner weight percent in the developer (toner carrier).

The specification of carrier will be described as follows.

Carrier No. 1

(Examples 1a, 1b and Comparative Examples 1 to 3)

In this case, spherical ferrite particles, the intensity of magnetization was 25 emu/g, were covered with copolymer resin of methylmethacrylate/styrene. The volume average particle size was 45 μm, and the density was 5.2 g/cm$^3$.

Carrier No. 2 (Example 1c, and Comparative Example 4)

In this case, 20 weight parts of methylmethacrylate/styrene copolymer and 80 weight parts of ferrite particles, the volume average particle size of which was 0.8 μm, and the intensity of magnetization of which was 30 emu/g, were melted, kneaded, and ground. In this way, carrier particles, the shape of which was infinite, were provided, wherein the volume average particle size was 45 μm, the intensity of magnetization was 27 emu/g, and the density was 2.9 g/cm$^3$.

The specification of toner will be described as follows.

In this case, 100 weight parts of styrene-acryl resin (Hymer up 110 manufactured by Sanyo Kasei Co.), 10 weight parts of color pigment, and 1 weight part of nigrosine were melted, kneaded, ground and classified. In this way, toner particles of yellow, magenta, cyan and black, the volume average particle size was 8.5 μm, were provided. Two weight parts of colloidal silica, which was a fluidization agent, were added to each toner. In this case, the density was 1.1 g/cm$^3$.

According to the conditions described above, and also according to the conditions shown in Tables 1 and 2, 50000 sheets of full color image recording was conducted. In Examples 1a to 1c, fog was not caused from the beginning of image recording to the end, and formed images had a high gradation, and further the density and resolution of the formed images were high. However, in Comparative Examples 1 to 4, the problems described in Table 2 were caused, so that the quality of the formed images were low.

TABLE 1

| Example and Comparative Example | Item | | | | |
|---|---|---|---|---|---|
| | DC voltage impressed upon the development sleeve (V) | AC voltage impressed upon the development sleeve (V) | AC frequency impressed upon the development sleeve (kHz) | DC voltage impressed upon the electrode (V) | Rotational speed of the development sleeve (r.p.m.) |
| Example 1a | −750 | 400 | 8 | −750 | 378 |
| Comparative Example 1 | −750 | 400 | 8 | −750 | 378 |
| Comparative Example 2 | −750 | 400 | 8 | −750 | 378 |
| Example 1b | −750 | 500 | 8 | −750 | 172 |
| Comparative Example 3 | −750 | 500 | 8 | −750 | 516 |
| Example 1c | −750 | 400 | 8 | −750 | 172 |
| Comparative Example 4 | −750 | 400 | 8 | −750 | 172 |

TABLE 2

| Example and Comparative Example | Item | | | | | | | | | |
|---|---|---|---|---|---|---|---|---|---|---|
| | Carrier No. | Volume average particle size of toner (μm) | Toner density (g/cm$^3$) | Toner concentration (Weight %) | Electric charge of toner (μC/g) | Amount of conveyance (mg/cm$^2$) | Height of the electrode $d_2$ (mm) | Vs/Vp | Dτ | Result |
| Example 1a | 1 | 8.5 | 1.1 | 7 | −20.0 | 20 | 0.25 | 2.2 | 5.5 | Good |
| Comparative Example 1 | 1 | 8.5 | 1.1 | 7 | −20.0 | 4 | 0.2 | 2.2 | 1.1 | Defective development |
| Comparative Example 2 | 1 | 8.5 | 1.1 | 7 | −20.0 | 40 | 0.3 | 2.2 | 11.1 | Fog, defective gradation, and stain in the apparatus |
| Example 1b | 1 | 8.5 | 1.1 | 7 | −20.0 | 25 | 0.25 | 1 | 3.4 | Good |
| Comparative Example 3 | 1 | 8.5 | 1.1 | 7 | −20.0 | 25 | 0.25 | 3 | 10.3 | Fog, defective gradation, and stain in the apparatus |
| Example 1c | 2 | 8.5 | 1.1 | 30 | −17.9 | 20 | 0.25 | 1 | 7.1 | Good |
| Comparative Example 4 | 2 | 8.5 | 1.1 | 30 | −17.9 | 30 | 0.3 | 1 | 10.7 | Fog, defective gradation, and stain in the apparatus |

In Comparative Example 1, for the purpose of enhancing the development property, the AC component of the bias voltage was further raised. However, fog was caused on the formed images, and there were no regions in which the development property and the occurrence of fog were compatible. In Comparative Examples 2 to 4, for the purpose of reducing the occurrence of fog and improving the gradation, the AC component of the bias voltage was lowered. However, the development property was lowered, and there were no regions in which both of them were compatible.

Due to the arrangement described above, the following advantages can be provided by the development apparatus of the present invention.

(a) No problems are caused even when carrier particles, the average particle size of which is not more than 30 μm, are used, and also even when toner particles, the average particle size of which is not more than 10 μm, are used. A multi-color image formed on the image forming body is transferred on a transfer sheet so that a color image can be formed. In the image formation process, it is possible to obtain a stably high development property and high gradation.

(b) On the insulating member in the development region or in the upstream of the development region, there is provided a control electrode composed of the linear electrode and the overhang member, so that the amount of conveyance of developer can be regulated to be an appropriate value. Accordingly, the generation of unnecessary clouds can be avoided in the conveyance path of developer, and a predetermined amount of developer can be stably conveyed.

(c) When the primary magnetic pole is arranged in the development region A and the control electrode 84 having the overhang member is arranged close to the primary magnetic pole, the bristles of developer can be appropriately regulated, so that the deposition of carrier can be avoided and the development property can be enhanced while the development bias voltage is maintained low.

According to the present invention, it is possible to provide the excellent developing apparatus described above.

Figure 9:
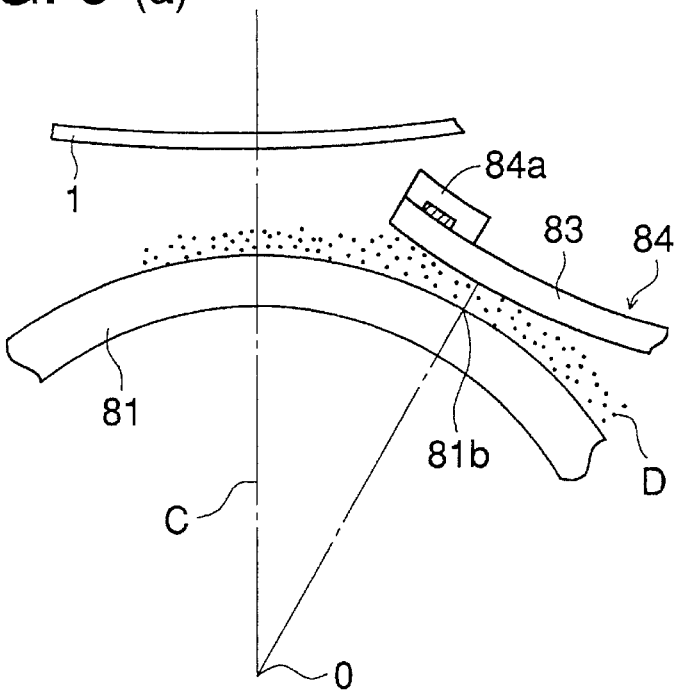
FIGS. 9(*a*) and 9(*b*) are side views showing a condition in which the control electrode is installed.
Figure 9:
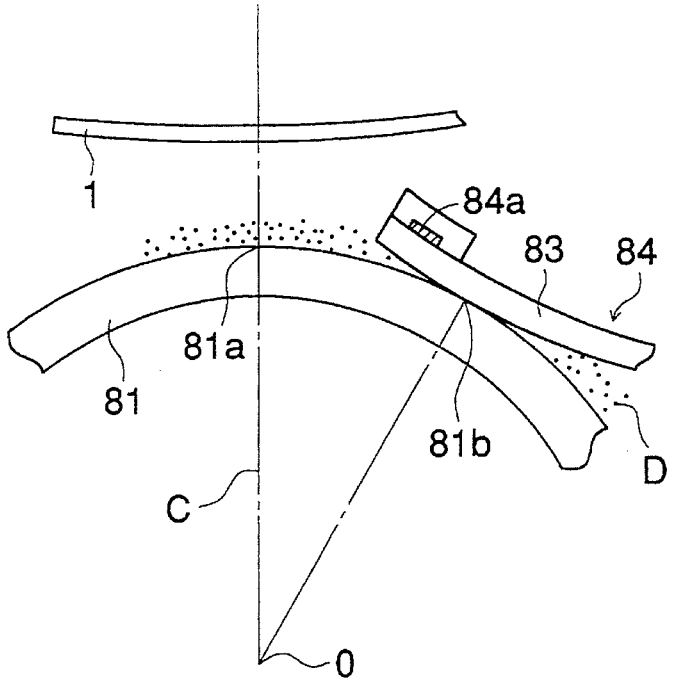

As illustrated in FIGS. 9(*a*) and 9(*b*), when developer D is conveyed onto the development sleeve 81, it enters between the insulating member 83 and the development sleeve 81. Therefore, the control electrode 84 is a little curved, and a small clearance is formed between the insulating member 83 and the development sleeve 81. Alternatively, there is provided no clearance between the insulating member 83 and the development sleeve 81. In other words, the insulating member 83 is opposed to the development sleeve 81 under the condition of contact/adjacency. Also, the condition of adjacency can be defined as follows. When the developing apparatus 8 is stopped and the bias voltage is not impressed, the insulating member 83 is not contacted with developer D. The above condition could be said to be the condition of adjacency. A portion on the development sleeve 81 where the insulating member 83 of the control electrode 84 is contacted with or adjacent to the development sleeve 81, is defined as the closest point, which is represented by the reference numeral 81*b*.

In the example described above, it is preferable that the following relation is satisfied between the amount of conveyance of developer D on the development sleeve 81 and the bristles of developer.

In this case, $D_{ws}$ is defined as an amount (mg/cm$^2$) of conveyed developer per unit area on the development sleeve 81 in the development region A. Then the following inequality is satisfied.

$$5<D_{ws}<70$$

It is preferable that the following inequality is satisfied.

$$10<D_{ws}<60$$

In this case, $h_1$ is defined as a height (μm) of bristles of developer in the development region when the control electrode 84 is contacted with or adjacent to the development sleeve 81, and $h_2$ is defined as a height (μm) of bristles of developer in the development region when the control electrode 84 is not contacted with or adjacent to the development sleeve 81. Then the following inequality is satisfied.

$$0.3<h_1/h_2\leqq 1$$

It is preferable that the following inequality is satisfied.

$$0.4<h_1/h_2<0.9$$

When the control electrode 84 is not contacted with developer D, the expression $h_1/h_2=1$ is satisfied.

When an amount of conveyed developer is small, that is, when $D_{ws}$ is lower than 5 (mg/cm$^2$), the development property is deteriorated and the image density is low.

When an amount of conveyed developer is high, that is, when $D_{ws}$ is higher than 70 (mg/cm$^2$), fog is caused on the image and further carrier particles are deposited on the image forming body.

It is necessary that the value $h_1/h_2$ is lower than 1 and higher than 0.3. When the value $h_1/h_2$ is not more than 0.3, the bristles of developer D is excessively compressed and the development property is deteriorated. When the control electrode is not contacted with or adjacent to the development sleeve, excellent development result can be provided even if $h_1/h_2$ is 1. However, in order to enhance the reproduction property of fine lines and the grain property of a solid portion by appropriately increase the density of the developer layer, it is preferable that the control electrode is contacted with the developer layer and the value $h_1/h_2$ is maintained to satisfy the inequality $0.4<h_1/h_2<0.9$.

When the value $h_1/h_2$ satisfies the inequality $0.3<h_1/h_2\leqq 1$, it is possible to obtain an excellent image when $D_T$ is in a range of $5<D_T<9$. That is, when the value $h_1/h_2$ is not more than 0.3, the developer layer is excessively compressed, so that the development property is deteriorated. When the value $h_1/h_2$ is made to be in a range of $0.4<h_1/h_2<0.9$ by contacting the control electrode with the developer layer so as to appropriately increase the density of the developer layer, the reproducing property of fine lines and the grain property of a solid portion are enhanced. Therefore, it is possible to enhance the image quality.

When the value $D_{ws}$ is not more than 5, in order to $D_T$ in a range of $1.5<D_T<9$, it is necessary to increase the toner concentration and also increase the rotational speed of the development sleeve. However, due to the foregoing, toner is scattered and developer is deteriorated. When $D_{ws}$ is not less than 0.07, due to the bristles of developer, it is difficult to convey the developer layer to the photoreceptor under the non-contact condition.

The above descriptions are summarized as follows. When the value $h_1/h_2$ is in a range satisfying the inequality $0.3<h_1/h_2\leqq 1$, it is easy to set the value $D_T$ in a range satisfying the inequality $1.5<D_T<9$, and an image of high quality can be provided. Further, when the value $D_{ws}$ is set in a range satisfying the inequality $5<D_{ws}<70$, the scatter of toner and the deterioration of developer are difficult to occur, so that it becomes easy to convey the developer layer to the photoreceptor under the non-contact condition.

The value $h_1/h_2$ is adjusted by the positions of the regulating blade 86 and the control electrode 84, and also the value $h_1/h_2$ is adjusted by the pushing forces of the regulating blade 86 and the control electrode 84. When the control electrode 84 is pressed against the developer D layer by the pressure of 0.1 to 60 g/cm, the above value can be provided. It is preferable that the control electrode 84 is pressed against the developer D layer by the pressure of 1 to 40 g/cm.

When the pushing force is lower than 0.1 g/cm, it is insufficient, and the control electrode can not be arranged with accuracy. When the pushing force is insufficient, the control electrode is oscillated in accordance with the rotation of the development sleeve 81, and the developing property becomes unstable.

When the pushing force exceeds 60 g/cm, it is excessively high, and the amount of conveyed developer and the height of bristles of developer are overcontrolled.

Figure 8:
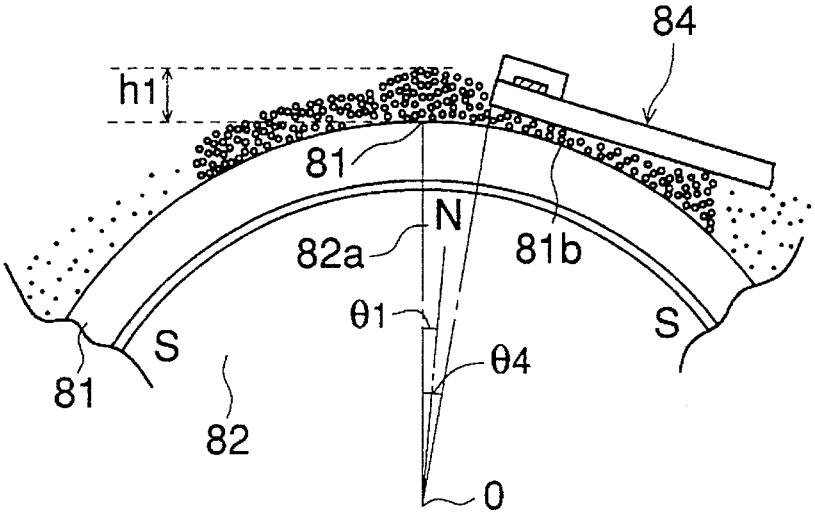
FIGS. 8(*a*) and 8(*b*) are side views showing bristles of developer.
Figure 8:
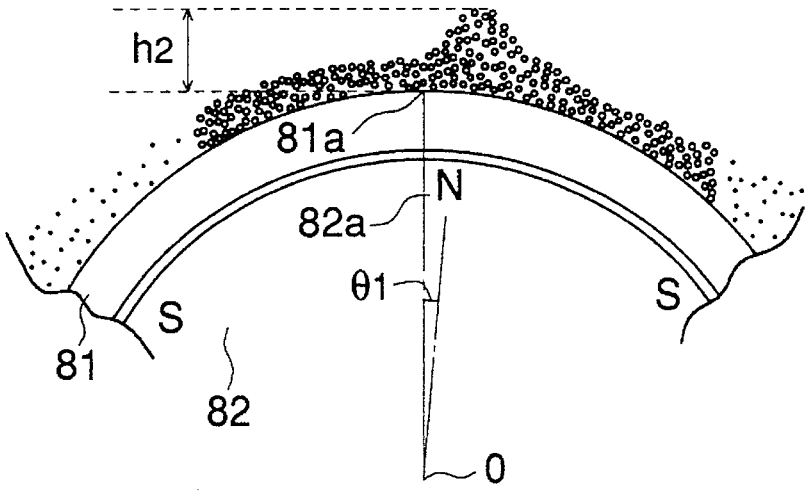

In this case, the height of bristles of developer D is measured as follows. In the measurement, the developing unit is stopped, and the bias voltage is not impressed. A profile projector (type 6C-2 manufactured by Nikon Co.) is used under the condition of magnifying power of 50, and a distance from the highest portion of the bristles to the surface of the development sleeve 81 is measured so that the heights $h_1$ and $h_2$ of developer D are found (shown in FIGS. 8(*a*) and 8(*b*)). The above measurement is made in two cases by 20 times, one is a case in which the control electrode 84 is provided, and the other is a case in which the control electrode 84 is not provided. The averages are respectively found so that $h_1$ and $h_2$ can be determined.

In this case, the speed of the photoreceptor belt 1, which is an image forming body, in the development region A is defined as $v_p$ (mm/sec), and the speed of the development sleeve 81, which is a developer conveyer, is defined as $v_s$ (mm/sec).

It is preferable that $v_s/v_p$ is 1 to 4, and more preferably 1 to 2.5.

The value of $v_s/v_p$ is adjusted by changing the rotational speed of the development sleeve 81. When the value $v_s/v_p$ is lower than 1, an amount of toner conveyed into the developing region A is decreased, and the development property is deteriorated. When the value $v_s/v_p$ is higher than 4, a bias is generated at the end portion of a solid image, especially at the rear end portion of a solid image, because development is conducted under the condition of oversupply of toner.

In order to avoid the occurrence of the above bias, it is necessary that the value $v_s/v_p$ is close to 1 as possible. From the same reason, it is preferable that the moving direction of the developer conveyer is the same as that of the image forming body.

Figure 10:
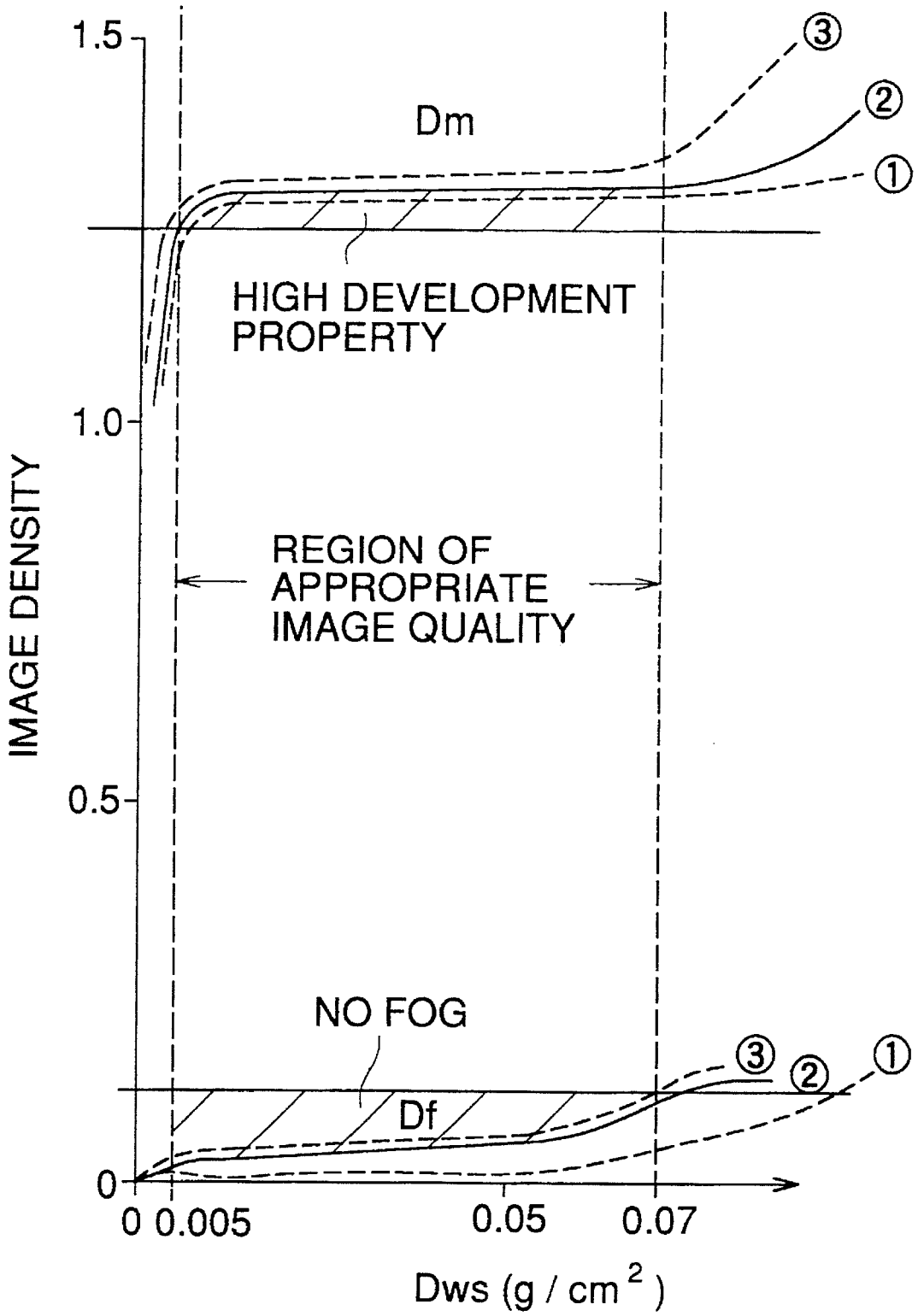
FIG. 10 is a graph showing a relation between an amount of conveyed developer and image density and also showing a preferable region.

FIG. 10 shows a relation between an amount of conveyed developer $D_{ws}$ (mg/cm$^2$) and the maximum image density $D_m$, and also shows a relation between an amount of conveyed developer $D_{ws}$ (mg/cm$^2$) and the image white portion density $D_f$, wherein an amount of conveyed developer $D_{ws}$ (g/cm$^2$) was changed. In this case, the developing apparatus of Example 2 shown in FIG. 1, developer and the color image forming apparatus shown in FIG. 2 were used. As described above, $D_{ws}$ was changed when a clearance between the developer amount regulating member 86 and the developer conveyer 81 was changed. This result was provided in the following manner. Only the black developing unit 8D in the image forming apparatus shown in FIG. 2 was used. Black toner development was made using the maximum voltage (−850 V in the non-exposure section) on the image forming body, and also black toner development was made using the minimum voltage (−50 V in the exposure section). The formed image was transferred onto a transfer sheet by means of corona discharge. The thus transferred image was fixed by a heat roller. Density of the formed image was measured by an image density meter (RD918 manufactured by Macbeth Co.). In general, it is necessary that the image density in an exposed portion, which is an image portion, is not less than 1.3. When the image density is lower than 1.3, it is judged that the development property is not good. In general, it is necessary that the image density in an unexposed portion, which is a non-image portion, is not more than 0.1. When the image density is higher than 0.1, it is judged that fog on the image is excessively high. As can be seen from the drawing, when $D_{ws}$ was in a range 5 to 70 mg/cm$^2$, an image of high quality was formed, wherein fog was not caused on thew image, and the image density was high. In this case, the closest distance from the image forming body 1 to the developer conveyer 81 is $d_1$ (mm), the height of the electrode 84*a* from the development sleeve is $d_2$ (mm), the volume average particle size of toner is $d_t$ (μm), and the average electric charge of toner is Q (μC/g). Then the zero-peak voltage ($V_{0-p}$) of the AC component impressed upon the development sleeve 81 is preferably in a range satisfying the inequality $20 \cdot Q \cdot d\ t \cdot d_1 > V_{0-p} > 3 \cdot Q \cdot d\ t \cdot d_2$, and more preferably $10 \cdot Q \cdot d_t \cdot d_1 > V_{0-p} > 5 \cdot Q \cdot d\ t \cdot d_2$. In this case, the average electric charge Q of toner is measured in the following manner. An electrically conductive plate of 2 cm×5 cm is opposed to the development roller of 20 mm diameter, wherein the closest distance was 0.7 mm. While the development roller is supplied with developer and rotated at the rotational speed of 200 rpm, a superimposed voltage of DC and AC (for example, DC: 1000 V, AC: 750 V, and frequency of AC: 8 kHz) is impressed upon the development roller, and toner in the developer is developed on the electrically conductive plate. The electrically conductive plate on which the toner has been developed is connected with the Faraday Gauge, and the toner is blown away by nitrogen gas. The electric charge and weight of the toner that has blown away are measured, so that the average electric charge Q of toner can be found. In this case, $d_2$ is a height (mm) of the electrode 84*a* from the development sleeve 81. From the viewpoint of prevention of discharge to the image forming body and also from the view point of ensuring the development property, it is preferable that $d_2$ is (0.2 to 0.6)$d_1$. In FIG. 10, reference numeral (1) represents a case in which the zero-peak voltage is 130 $V_{0-p}$, reference numeral (2) represents a case in which the zero-peak voltage is 800 $V_{0-p}$, and reference numeral (3) represents a case in which the zero-peak voltage is 1600 $V_{0-p}$, wherein the frequency is 8 kHz in any cases. When the AC voltage to be impressed is too high and exceeds this range, electric discharge is caused between the developer conveyer and the control electrode. As a result, it is impossible to obtain an image of high quality, and further the control electrode tends to be damaged. When the AC voltage to be impressed is too low and exceeds this range, the intensity of the electric field formed between the developer conveyer and the control electrode is extremely weakened. As a result, it is impossible to obtain a sufficiently high development property. When $D_{WS}$ is in the range from 5 to 70 mg/cm$^2$ and the AC voltage to be impressed is in the above range, it is possible to obtain a high development property, and at the same time occurrence of fog can be prevented as illustrated in FIG. 10. It is preferable that the frequency of the impressed AC component is 100 Hz to 20 kHz, and more preferably 1 kHz to 10 kHz.

In FIG. 10, the DC component impressed upon the developer conveyer 81 and the electrode 84*a* is determined to be −750 V that is the same as Example 1. Of course, the results of the developing units except for black are the same.

Depending upon the magnetic body content, the carrier density is approximately 1.8 to 7 g/cm$^3$, and preferably 2 to 6 g/cm$^3$. When the carrier density is lower than 1.8 g/cm$^3$, carrier tends to scatter due to the rotation of the development sleeve 81. When the carrier density is higher than 7 g/cm$^3$, toner is given a higher stress, so that the durability of developer D is deteriorated.

In this case, the density was measured with the dry type density meter of Accupyc 1330 manufactured by Micrometrics Co.

EXAMPLE 2

Example 2 was accomplished using the same apparatus and condition as those of Example 1 described before. Only different points will be described as follows. $V_p$ (mm/sec) represents the moving speed of the photoreceptor belt in the development region. $V_s$ (mm/sec) represents the moving speed of the development sleeve in the development region. The ratio $V_s/V_p$ is set at 2.2.

In the developer D, toner and carrier were mixed so that the toner concentration could be 10 weight percent. The amount of conveyed developer was set at 20 mg/cm$^2$, and the ratio $h_1/h_2$ was set at 0.64. The pushing force of the control electrode 84 was set at 3 g/cm. In this connection, the toner concentration indicates the weight percent of toner contained in the developer.

Concerning the carrier, carrier No. 1, which was the same as that of Examples 1a, 1b and Comparative Examples 1 to 3, was used.

Concerning the toner, the same toner as that of Examples 1a to 1c and Comparative Examples 1 to 4, was used.

78 mg/cm$^2$. Other points were the same as those of Example 2.

In Examples 2, 3 and Comparative Examples 5, 6, 7, 50000 sheets of image recording of full color were accomplished under the conditions shown on Table 3.

TABLE 2

| Example and Comparative Example | Item | | | | | | | | | |
|---|---|---|---|---|---|---|---|---|---|---|
| | Carrier No. | Volume average particle size of toner (μm) | Toner density (g/cm$^3$) | Toner concentration (Weight %) | Electric charge of toner (μC/g) | Amount of conveyance (mg/cm$^2$) | Height of the electrode $d_2$ (mm) | Vs/Vp | Dτ | Result |
| Example 1a | 1 | 8.5 | 1.1 | 7 | −20.0 | 20 | 0.25 | 2.2 | 5.5 | Good |
| Comparative Example 1 | 1 | 8.5 | 1.1 | 7 | −20.0 | 4 | 0.2 | 2.2 | 1.1 | Defective development |
| Comparative Example 2 | 1 | 8.5 | 1.1 | 7 | −20.0 | 40 | 0.3 | 2.2 | 11.1 | Fog, defective gradation, and stain in the apparatus |
| Example 1b | 1 | 8.5 | 1.1 | 7 | −20.0 | 25 | 0.25 | 1 | 3.4 | Good |
| Comparative Example 3 | 1 | 8.5 | 1.1 | 7 | −20.0 | 25 | 0.25 | 3 | 10.3 | Fog, defective gradation, and stain in the apparatus |
| Example 1c | 2 | 8.5 | 1.1 | 30 | −17.9 | 20 | 0.25 | 1 | 7.1 | Good |
| Comparative Example 4 | 2 | 8.5 | 1.1 | 30 | −17.9 | 30 | 0.3 | 1 | 10.7 | Fog, defective gradation, and stain in the apparatus |

EXAMPLE 3

In Example 3, the same apparatus as that of Examples 1 and 2 was used, and also the same toner as that of Examples 1 and 2 was used. Developer D was used, in which the toner concentration was maintained at 20 weight percent. The amount of conveyed developer was set at 4 mg/cm$^2$. In the apparatus, the values of $h_1$, $h_2$, $d_2$ and the pushing pressure of the control electrode 84 were changed as shown on Table 3.

Concerning the carrier, carrier No. 2, which was the same as the carrier used in Example 1c and Comparative Example 4, was used.

COMPARATIVE EXAMPLE 5

In this case, the values of $h_1$, $h_2$, $d_2$ were changed and further the pushing pressure of the control electrode was changed to 6.5 g/cm. Other points were the same as those of Example 2.

COMPARATIVE EXAMPLE 6

In this case, the values of $h_1$, $h_2$, $d_2$ were changed and further the amount of conveyed developer was changed to 4 mg/cm$^2$. Other points were the same as those of Example 2.

COMPARATIVE EXAMPLE 7

In this case, the values of $h_1$, $h_2$, $d_2$ were changed and further the amount of conveyed developer was changed to Results of the tests will be described below. As shown on Table 3, in Examples 2 and 3, the gradation was excellent from the beginning to the end of recording, and the density and resolution were stably high. However, in Comparative Examples 5, 6, the problems shown on Table 3 were encountered, and excellent images were not stably provided.

In Comparative Examples 5 and 6, in order to enhance the development property, the AC component of the bias voltage was further raised, however, for occurred-on the formed images, and it was impossible to find a region in which the development property was compatible with the prevention of fog.

In Comparative Example 7, in order to avoid the occurrence of fog and defective gradation, the AC component of the bias voltage was lowered, however, the development property was deteriorated, and it was impossible to find a region in which the development property was compatible with the prevention of fog.

As long as a 2-component developer, the toner of which is magnetic, is used, a magnetic latent image can be made visual under the same development condition of Examples 2 and 3.

According to the present invention, the following effects can be provided. In the non-contact type developing apparatus having a control electrode, when the amount of conveyed developer $D_{WS}$ (mg/cm$^2$) is set at $5<D_{WS}<70$, and when the height of bristles of developer is maintained so that the inequality $0.3<h_1/h_2 23\ 1$ can be satisfied, even if the average particle size of carrier is not more than 30 μm and the average particle size of toner is not more than 10 μm, the developing property and gradation can be stably enhanced by impressing a low development bias voltage.

What is claimed is:

1. A non-contact type of developing device for use in an image forming apparatus having an image forming body, said developing device comprising:

(a) a developer conveying body facing the image forming body in which a magnet body having a plurality of magnet poles are attached therein, for conveying two-component developer in the form of a developer layer onto a developing area; and (b) a control electrode provided at the developing area or upstream of the developing area, said control electrode having an electrically insulating member which is in contact with or close to the developing layer, and an electrode attached to said insulating member, a voltage being applicable to said electrode, wherein the following inequality is satisfied:

$$1.5 < D_T = \frac{3\sqrt{3} \cdot D_{WS} \cdot T_C \cdot vs}{10 \cdot \pi \cdot dt \cdot \rho t \cdot vp} < 9$$

where $D_T$ represents a number of toner layers on the assumption that the toner particles passing through the developing area are filled most densely, $D_{WS}$ represents a conveying amount (mg/cm$^2$) of the developer layer at the developing area on the developer conveying body, $T_c$ represents a toner concentration (%) in the developer, dt represents an average sphere equivalent diameter (μm) of toner in the developer, ρt represents a toner density (g/cm$^3$) in the developer, vs represents a circumferential speed (mm/s) of the developer conveying body at the developing area, and vp represents a circumferential speed (mm/s) of the image forming body at the developing area.

2. The developing device of claim 1, wherein the following inequality is satisfied:

$$5 < D_{WS} < 70$$

where $D_{WS}$ represents the conveying amount (mg/cm$^2$) of the developer conveyed to the developing area.

3. The developing device of claim 2 further comprising a main magnet pole provided inside the developer conveying body at a position where the main magnet body is opposite to the developing area, wherein the following inequality is satisfied:

$$0.3 < h_1/h_2 \leqq 1$$

where $h_1$ represents a height (μm) of a developing brush at the developing area in static state when said control electrode is in contact with or close to the developing layer, $h_2$ represents a height (μm) of a developing brush at the developing area in static state when said control electrode is not provided.

4. The developing device of claim 1, wherein the following inequality is satisfied:

$$0.3 < h_1/h_2 \leqq 1$$

where $h_1$ represents a height (μm) of a developing brush at the developing area when said control electrode is in contact with or close to the developing layer in static state, $h_2$ represents a height (μm) of a developing brush at the developing area when said control electrode is not provided.

5. The developing device of claim 4 further comprising a main magnet pole provided inside the developer conveying body at a position where the main magnet body is opposite to the developing area.

6. The developing device of claim 2, wherein the following condition is satisfied:

$$0.3 < h_1/h_2 \leqq 1$$

where $h_1$ represents a height (μm) of a developing brush at the developing area in static state when said control electrode is in contact with or close to the developing layer, $h_2$ represents a height (μm) of a developing brush at the developing area in static state when said control electrode is not provided.

7. The developing device of claim 6 further comprising a main magnet pole provided inside the developer conveying body at a position where the main magnet body is opposite to the developing area.

* * * * *